US009797400B2

(12) United States Patent
Yun et al.

(10) Patent No.: US 9,797,400 B2
(45) Date of Patent: Oct. 24, 2017

(54) SCROLL COMPRESSOR

(71) Applicant: LG ELECTRONICS INC., Seoul (KR)

(72) Inventors: Juhwan Yun, Seoul (KR); Taeyeon Kim, Seoul (KR); Suchul Kim, Seoul (KR); Honggyun Jin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 266 days.

(21) Appl. No.: 14/700,304

(22) Filed: Apr. 30, 2015

(65) Prior Publication Data

US 2015/0316057 A1 Nov. 5, 2015

(30) Foreign Application Priority Data

May 2, 2014 (KR) ..... 10-2014-0053400
May 2, 2014 (KR) ..... 10-2014-0053654

(51) Int. Cl.

| | |
|---|---|
| ***F01C 1/02*** | (2006.01) |
| ***F01C 1/063*** | (2006.01) |
| ***F04C 2/00*** | (2006.01) |
| ***F04C 27/00*** | (2006.01) |
| ***F04C 29/12*** | (2006.01) |
| ***F04C 23/00*** | (2006.01) |
| ***F04C 28/24*** | (2006.01) |

(Continued)

(52) U.S. Cl.

CPC ..... *F04C 27/005* (2013.01); *F04C 18/0215* (2013.01); *F04C 23/008* (2013.01); *F04C 28/24* (2013.01); *F04C 28/26* (2013.01); *F04C 29/124* (2013.01)

(58) Field of Classification Search

CPC .. F04C 18/0215; F04C 23/008; F04C 27/005; F04C 28/24; F04C 28/26; F04C 29/124

USPC ..... 418/55.1, 270

See application file for complete search history.

(56) References Cited

U.S. PATENT DOCUMENTS 7,429,167 B2 * 9/2008 Bonear ..... F04C 28/28 137/514.3
2013/0251574 A1 9/2013 Heusler et al.

FOREIGN PATENT DOCUMENTS

| | | |
|---|---|---|
| EP | 1 087 142 | 3/2001 |
| KR | 10-2000-0037517 | 6/2001 |
| KR | 10-1378886 | 3/2014 |

OTHER PUBLICATIONS

European Search Report dated Sep. 9, 2015.

* cited by examiner

*Primary Examiner* — Mark Laurenzi
*Assistant Examiner* — Anthony Ayala Delgado
(74) *Attorney, Agent, or Firm* — KED & Associates, LLP

(57) ABSTRACT

A scroll compressor is provided that may include a casing including a rotational shaft, a cover fixed inside of the casing to partition the inside of the casing into a suction space and a discharge space, a first scroll revolved by rotation of the rotational shaft, a second scroll disposed on or at one side of the first scroll to define a compression chamber together with the first scroll, the second scroll including a discharge, through which a refrigerant pressed in the compression chamber may be discharged, a switching device movably disposed on or at one side of the discharge to selectively open and close the discharge, a back pressure portion including a moving guide that accommodates at least a portion of the switching device, and a top surface that covers one side of the switching device; and an adhesion preventer that reduces a contact area between the switching device and at least a portion of the back pressure portion.

28 Claims, 19 Drawing Sheets

(51) Int. Cl.
*F04C 28/26* (2006.01)
*F04C 18/02* (2006.01)

SCROLL COMPRESSOR

CROSS-REFERENCE TO RELATED APPLICATION(S)

The present application claims priority under 35 U.S.C. 119 and 35 U.S.C. 365 to Korean Patent Application No. 10-2014-0053400, filed in Korea on May 2, 2014, and 10-2014-0053654, filed in Korea on May 2, 2014, which are hereby incorporated by reference in their entirety.

BACKGROUND

1. Field

A scroll compressor is disclosed herein.

2. Background

A scroll compressor is a compressor that includes a fixed scroll having a spiral wrap, and an orbiting scroll that revolves with respect to the fixed scroll, that is, a compressor in which the fixed scroll and the orbiting scroll are engaged with each other. The orbiting scroll revolves with respect to the fixed scroll, thereby reducing a volume of a compression chamber, which is formed between the fixed scroll and the orbiting scroll according to an orbiting motion of the orbiting scroll, thus increasing a pressure of a fluid, which is then discharged through a discharge hole formed at a central portion of the fixed scroll. Such a scroll compressor has a feature in which suction, compression, and discharge of a fluid are successively performed while the orbiting scroll revolves. Accordingly, a discharge valve and suction valve may be unnecessary in principle. Also, as a number of components of the scroll compressor is less in comparison to other types of compressors, the scroll compressor may be simplified in structure and rotate at a high speed. Also, as a variation in torque required for the compression is less in comparison to other types of compressors, and suction and compression successively occur, a relatively small amount of noise and vibration may occur.

Important issues in scroll compressors is leakage and lubrication between the fixing scroll and the orbiting scroll. That is, to prevent a refrigerant from leaking between the fixed scroll and the orbiting scroll, an end of a wrap has to be closely attached to a surface of a head plate to prevent compressed refrigerant from leaking. The "head plate" may refer to a portion that corresponds to a main body of the fixed scroll or the orbiting scroll. That is, ahead plate of the fixed scroll may be closely attached to a wrap of the orbiting scroll, and ahead plate of the orbiting scroll may be closely attached to a wrap of the fixed scroll.

On the other hand, friction resistance has to be minimized so as to allow the orbiting scroll to smoothly revolve with respect to the fixed scroll. However, the leakage may conflict with the lubrication. That is, when the end of the wrap and the surface of the head plate are strongly attached to each other, it may be advantageous with respect to leakage, but friction may increase, increasing damage due to noise and abrasion. On the other hand, when adhesion strength is low, the friction may be reduced, however, a sealing force may decrease, increasing the leakage.

Thus, in the related art, a back pressure chamber having an intermediate pressure, which is defined as a value between a discharge pressure and a suction pressure, may be formed in or at a back surface of the orbiting scroll or the fixed scroll to solve the limitations with respect to sealing and friction reduction. That is, the back pressure chamber, which communicates with a compression chamber having an intermediate pressure of a plurality of compression chambers formed between the orbiting scroll and the fixed scroll, may be formed to allow the orbiting scroll and the fixed scroll to be adequately attached to each other, thereby solving the limitations with respect to the leakage and lubrication.

The back pressure chamber may be formed on a bottom surface of the orbiting scroll or a top surface of the fixed scroll. For convenience of description, the back pressure chamber formed on the bottom surface of the orbiting scroll and the back pressure chamber formed on the top surface of the fixed scroll may be referred to as a "lower back pressure type scroll compressor" and an "upper back pressure type scroll compressor", respectively. The lower back pressure type scroll compressor has advantages in that the lower back pressure type scroll compressor has a simple structure, and a bypass hole is easily formed. However, as the back pressure chamber is formed on the bottom surface of the orbiting scroll, which performs the orbiting motion, the back pressure chamber may change in configuration and position according to the orbiting motion. As a result, the orbiting scroll may be tilted, causing vibration and noise. In addition, an O-ring provided to prevent the refrigerant from leaking may be quickly worn out. The upper back pressure type scroll compressor has a relatively complicated structure. However, as the back pressure chamber is fixed in configuration and position, the fixed scroll may not be tilted, and sealing of the back pressure chamber may be good.

An example of the upper back pressure type scroll compressor is disclosed in Korean Patent Application No. 10-2000-0037517 (hereinafter, the "'517 Application") entitled Method for Processing Bearing Housing And Scroll Machine Having Bearing Housing, which is hereby incorporated by reference. FIG. 1 of the '517 Application is a cross-sectional view illustrating an example of an upper back pressure type scroll compressor according to the related art. Referring to FIG. 1, the scroll compressor includes an orbiting scroll disposed on a main frame fixedly installed within a casing, and a fixed scroll engaged with the orbiting scroll. Also, a back pressure chamber is defined on the fixing scroll, and a floating plate to seal the back pressure chamber is disposed to vertically slide along an outer circumference of a discharge passage. A cover is disposed on a top surface of the floating plate to partition an inner space of the compressor into a suction space and a discharge space.

The back pressure chamber communicates with one of the compression chambers, and thus, an intermediate pressure is applied to the back pressure chamber. Also, a pressure may be applied upward to the floating plate and applied downward to the fixed scroll. When the floating plate ascends due to the pressure of the back pressure chamber, an end of the floating plate may contact the cover to seal the discharge space. Also, the fixed scroll may move downward and then be closely attached to the orbiting scroll.

However, in a case of the upper back pressure type scroll compressor, when an operation of the scroll compressor is stopped, an intermediate pressure refrigerant of the back pressure chamber may not be easily discharged toward the compression chamber and a suction-side by an orbiting scroll wrap. In detail, when the operation of the scroll compressor is stopped, the pressure within the scroll compressor may converge to a predetermined pressure (an equilibrium pressure). The equilibrium pressure may be a pressure slightly higher than a suction-side pressure. That is, the refrigerant of the compression chamber and the discharge-side refrigerant may be discharged, and the inside of the compressor may converge to the equilibrium pressure. Then, when the compressor operates again, the compressor may operate while a difference between the equilibrium pressure and a pressure at each position occurs.

It may be necessary to maintain the equilibrium pressure while the refrigerant of the back pressure chamber is discharged to the suction-side. If the refrigerant of the back pressure chamber is not discharged, the fixed scroll may be compressed downward by the pressure of the back pressure chamber, and thus, may be maintained in a state in which the fixed scroll is closely attached to the orbiting scroll.

Also, if the refrigerant of the back pressure chamber is not discharged, the pressure of the back pressure chamber may be maintained at the equilibrium pressure. Accordingly, the floating plate may move upward to contact the cover. As a result, the discharge passage for the discharge-side refrigerant may be blocked, preventing the discharge-side refrigerant from being discharged to the suction-side of the compressor, thereby further pressing the fixed scroll downward.

As described above, when the fixed scroll is pressed to maintain the state in which the fixed scroll is closely attached to the orbiting scroll at a pressure greater than a predetermined pressure, it may be difficult to quickly drive the scroll compressor again. As a result, to quickly drive the scroll compressor again, a high initial torque may be required. When the initial torque increases, noise and abrasion may occur, reducing operation efficiency of the compressor.

BRIEF DESCRIPTION OF THE DRAWINGS

Embodiments will be described in detail with reference to the following drawings in which like reference numerals refer to like elements, and wherein.

DETAILED DESCRIPTION

Figure 1:
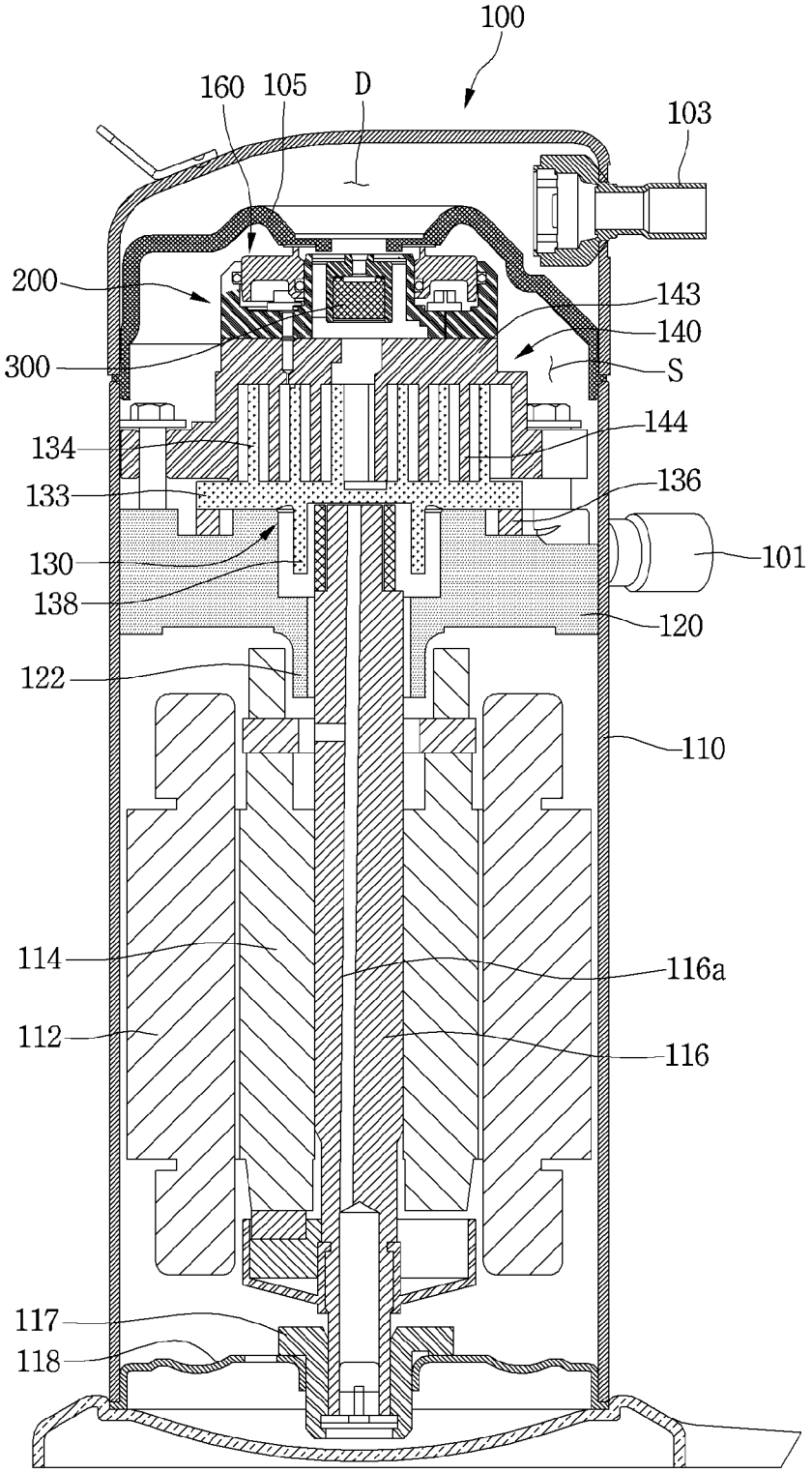
FIG. 1 is a cross-sectional view of a scroll compressor according to an embodiment.
Figure 2:
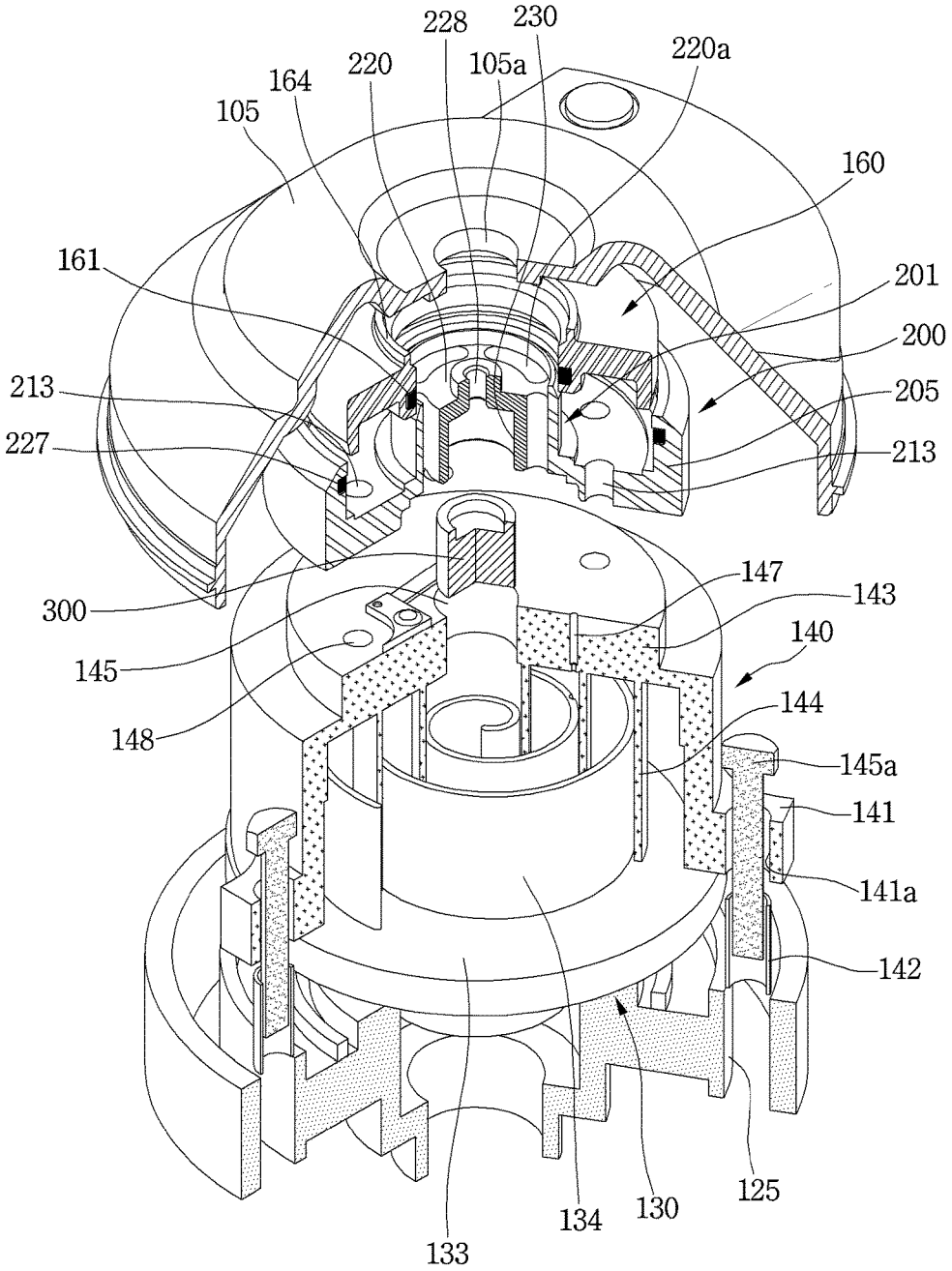
FIG. 2 is a partial exploded cross-sectional view of the scroll compressor of FIG. 1.
Figure 3:
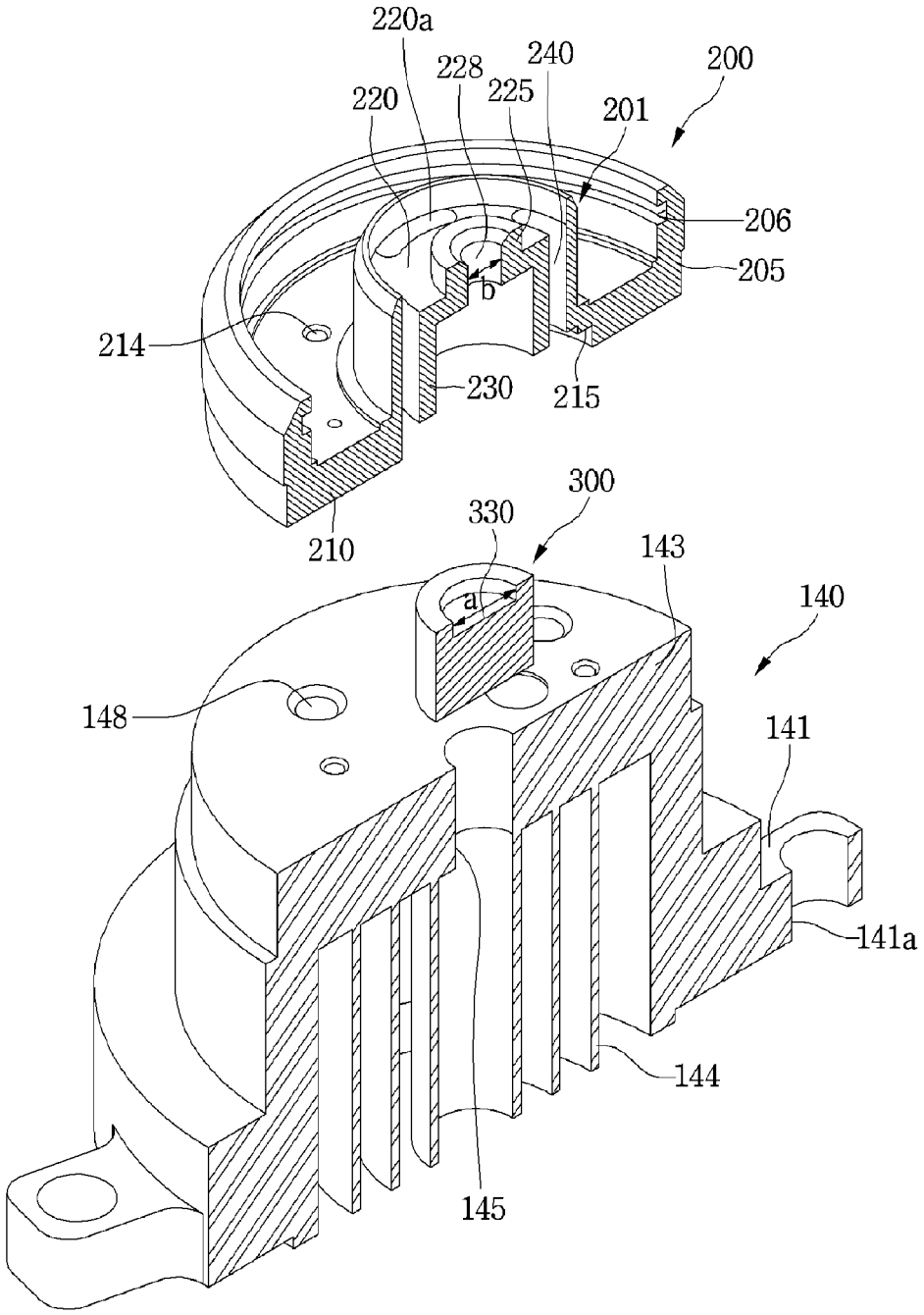
FIG. 3 is an exploded perspective view of a back pressure portion and a fixed scroll of the scroll compressor of FIG. 1.
Figure 4:
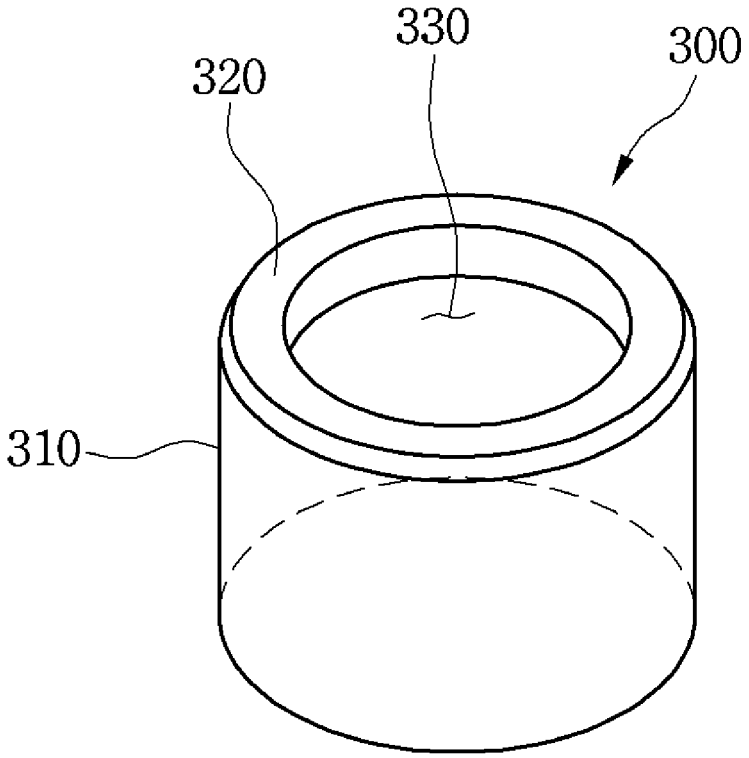
FIG. 4 is a view of a switching device of the scroll compressor of FIG. 1.

FIG. 1 is a cross-sectional view of a scroll compressor according to an embodiment, FIG. 2 is a partial exploded cross-sectional view of the scroll compressor of FIG. 1. FIG. 3 is an exploded perspective view of a back pressure portion and a fixed scroll of the scroll compressor of FIG. 1. FIG. 4 is a view of a switching device of the scroll compressor of FIG. 1.

Referring to FIGS. 1 to 3, a scroll compressor 100 according to this embodiment may include a casing 110 having a suction space S and a discharge space D. In detail, a cover 105 may be disposed in an inner upper portion of the casing 110. An inner space of the casing 110 may be partitioned into the suction space S and the discharge space D by the cover 105. An upper side of the cover 105 may correspond to the discharge space D, and a lower side of the cover 105 may correspond to the suction space S. A discharge hole 105*a*, through which a refrigerant compressed at a high pressure may be discharged, may be defined in an approximately central portion of the cover 105.

The scroll compressor 100 may further include a suction port 101 that communicates with the suction space S, and a discharge port 103 that communicates with the discharge space D. Each of the suction port 101 and the discharge port 103 may be fixed to the casing 101 to allow the refrigerant to be suctioned into the casing 110 or discharged outside of the casing 110.

A motor may be disposed at a lower portion of the suction space S. The motor may include a stator 112 coupled to an inner wall of the casing 110, a rotor 114 rotatably disposed within the stator 112, and a rotational shaft 116 that passes through a central portion of the stator 114.

A lower portion of the rotational shaft 116 may be rotatably supported by an auxiliary bearing 117 disposed on or at a lower portion of the casing 110. The auxiliary bearing 117 may be coupled to a lower frame 118 to stably support the rotational shaft 116.

The lower frame 118 may be fixed to the inner wall of the casing 110, and a bottom surface of the casing 110 may be used as an oil storage space. Oil stored in the oil storage space may be transferred upward by an oil supply passage 116*a* defined in the rotational shaft 116 and uniformly supplied to components within the casing 110, for example, a fixed scroll 140, an orbiting scroll 130, a back pressure portion 200, and a floating plate 160. The oil may lubricate or cool the components within the casing 110 so that the scroll compressor 100 may smoothly operate. The oil supply passage 116*a* may be eccentrically disposed toward one side so that the oil introduced into the oil supply passage 116*a* may flow upward by a centrifugal force generated by rotation of the rotational shaft 116.

An upper portion of the rotational shaft 116 may be rotatably supported by a main frame 120. The main frame 120 may be fixed to the inner wall of the casing 110, similar to the lower frame 118. A main bearing 122 that protrudes downward may be disposed on a bottom surface of the main frame 120. The rotational shaft 116 may be inserted into the main bearing 122. An inner wall of the main bearing 122 may function as a bearing surface so that the rotational shaft 116 may smoothly rotate.

The orbiting scroll 130 may be disposed on a top surface of the main frame 120. The orbiting scroll 130 may include an orbiting head plate 133 having an approximately disk shape and disposed on the main frame 120, and an orbiting wrap 134 having a spiral shape and extending from the orbiting head plate 133. The orbiting head plate 133 may define a lower portion of the orbiting scroll 130 and function as a main body of the orbiting scroll 130, and the orbiting wrap 134 may extend upward from the orbiting head plate 133 to define an upper portion of the orbiting scroll 130. The orbiting wrap 134 together with a fixed wrap 144, which will be described hereinbelow, of the fixed scroll 140 may define a compression chamber. The orbiting scroll 130 may be referred to as a "first scroll", and the fixed scroll 140 may be referred to as a "second scroll".

The orbiting head plate 133 of the orbiting scroll 130 may revolve in a state in which the orbiting head plate 133 is supported on the top surface of the main frame 120. An Oldham ring 136 may be disposed between the orbiting head plate 133 and the main frame 120 to prevent the orbiting scroll 130 from revolving. Also, a boss 138, into which an upper portion of the rotational shaft 116 may be inserted, may be disposed on a bottom surface of the orbiting head plate 133 of the orbiting scroll 130 to easily transmit a rotational force of the rotational shaft 116 to the orbiting scroll 130. The fixed scroll 140 engaged with the orbiting scroll 130 may be disposed on the orbiting scroll 130.

The fixed scroll 140 may include a plurality of pin supports 141 that protrudes from an outer circumferential surface of the fixed scroll 140 and each of which may include a guide hole 141*a*, a guide pin 142 inserted into the guide hole 141*a* and disposed on the top surface of the main frame 120, and a coupling member 145*a* inserted into the guide pin 142 and fitted into an insertion hole 125 of the main frame 120.

The fixed scroll 140 may include a fixed head plate 143 having a disk shape, and the fixed wrap 144 that extends from the fixed head plate 143 toward the orbiting head plate 133 and engaged with the orbiting wrap 134 of the orbiting scroll 130. The fixed head plate 143 may define an upper portion of the fixed scroll 140 and function as a main body of the fixed scroll 140, and the fixed wrap 144 may extend downward from the fixed head plate 143 to define a lower portion of the fixed scroll 140. For convenience of description, the orbiting head plate 133 may be referred to as a "first head plate", and the fixed head plate 143 may be referred to as a "second head plate". Further, the orbiting wrap 134 may be referred to as a "first wrap", and the fixed wrap 144 may be referred to as a "second wrap".

An end of the fixed wrap 144 may be disposed to contact the orbiting head plate 133, and an end of the orbiting wrap 134 may be disposed to contact the fixed head plate 143. The fixed wrap 144 may extend in a predetermined spiral shape, and a discharge hole 145, through which the compressed refrigerant may be discharged, may be defined in an approximately central portion of the fixed head plate 143. A suction hole (not shown), through which the refrigerant within the suction space S may be suctioned, may be defined in a side surface of the fixed scroll 140. The refrigerant suctioned through the suction hole (not shown) may be introduced into the compression chamber defined by the orbiting wrap 134 and the fixed wrap 144.

In detail, the fixed wrap 144 and the orbiting wrap 134 may define a plurality of compression chambers. Each of the compression chambers may be reduced in volume while revolving and moving toward the discharge hole 145 to compress the refrigerant. Thus, the compression chamber adjacent to the suction hole may be minimized in pressure, and the compression chamber that communicates with the discharge hole 145 may be maximized in pressure. Also, the compression chamber between the above-described compression chambers may have an intermediate pressure between a suction pressure of the suction hole 146 and a discharge pressure of the discharge hole 145. The intermediate pressure may be applied to a back pressure chamber BP, which will be described hereinbelow, to press the fixed scroll 140 toward the orbiting scroll 130.

An intermediate pressure discharge hole 147 to transfer the refrigerant of the compression chamber having the intermediate pressure to the back pressure chamber BP may be defined in the fixed head plate 143 of the fixed scroll 140. That is, the intermediate pressure discharge hole 147 may be defined in a portion of the fixed scroll 130 at which the pressure in the compression chamber that communicates with the intermediate pressure discharge hole 147 is greater than the pressure in the suction space S and less than the pressure in the discharge space D. The intermediate pressure discharge hole 147 may pass from a top surface to a bottom surface of the fixed head plate 143.

A back pressure chamber assembly 200 and 160 that define the back pressure chamber may be disposed on the fixed scroll 140. The back pressure chamber assembly 200 and 160 may include the back pressure portion 200, and a floating plate 160 separably coupled to the back pressure portion 150. The back pressure chamber assembly 200 and 160 may be disposed on an upper portion of the fixed head plate 143 of the fixed scroll 140.

The back pressure portion 200 may have an approximately annular shape with a hollow and include a support 210 that contacts and supports the fixed head plate 143 of the fixed scroll 140. An intermediate pressure suction hole 213 that communicates with the intermediate pressure discharge hole 147 may be defined in the support 210. The intermediate pressure suction hole 213 may pass from a top surface to a bottom surface of the support 210.

A second coupling hole 214 that communicates with a first coupling hole 148 defined in the fixed head plate 143 of the fixed scroll 140 may be defined in the support 210. The first coupling hole 148 and the second coupling hole 214 may be coupled to each other by a predetermined coupling member.

The back pressure portion 200 may include a plurality of walls 201 and 205 that extends upward from the support 210. The plurality of walls 201 and 205 may include a first wall 201 that extends upward from an inner circumferential surface of the support 210, and a second wall 205 that extends upward from an outer circumferential surface of the support 210. Each of the first and second walls 201 and 205 may have an approximately cylindrical shape.

The first and second walls 201 and 205 together with the support 210 may define a space having a predetermined shape. The space may define the above-described back pressure chamber BP.

A third wall 230 that accommodate a switching device 300 may be disposed inside of the first wall 210. The third wall 230 may have a cylindrical shape with a hollow and may be disposed to be spaced apart inward from the first wall 201.

The back pressure portion 200 may include a top surface 220 disposed on an upper portion of the third wall 230. The top surface 220 may be coupled to an inner circumferential surface of the first wall 201. The first wall 201 may extend upward from the support 210, so that an upper end of the first wall 201 may be disposed at a position higher than a position of the top surface 220. As the first wall 201 extends up to the position higher than the position of the top surface 220, the refrigerant discharged from at least one intermediate discharge hole 240 may not flow toward the second wall 205, but rather, may be guided to the first wall 201 so that the refrigerant is easily guided to the discharge hole 105*a*.

The intermediate discharge hole 240 that communicates with the discharge hole 145 of the fixed head plate 143 to discharge the refrigerant discharged from the discharge hole 145 toward the cover 105 may be disposed between an inner circumferential surface of the first wall 201 and an outer circumferential surface of the third wall 230. The intermediate discharge hole 240 may extend from a lower portion to an upper portion of the first wall 201. Further, a plurality of the intermediate discharge hole 240 may be provided. The top surface 220 may have a plurality of through-holes 220*a* that defines an upper end of each intermediate discharge hole 240, respectively.

As the intermediate discharge hole 240 is provided, a space defined between the first wall 201 having the cylindrical shape and the third wall 230 disposed inside the first wall 201 may communicate with the discharge hole 145 to define at least a portion of a discharge passage through which the discharged refrigerant may flow toward the discharge space D. The switching device 300 may have an approximately circular pillar shape and be disposed inside the third wall 230. The third wall 230 may be disposed to accommodate at least a portion of the switching device 300, and the top surface 220 may cover an upper side of the switching device 300.

The switching device 300 may be disposed above the discharge hole 145 and may have a size sufficient to completely cover the discharge hole 145. Thus, when the switching device 300 moves downward to contact the fixed head plate 143 of the fixed scroll 140, the switching device 300 may close the discharge hole 145 (see FIG. 9). The third wall 230 may be referred to as a "moving guide" in that the third wall 230 guides movement of the switching device 300. The switching device 300 may be movable upward or downward according to a variation in pressure applied to the switching device 300.

A discharge pressure apply hole 228 may be defined in the top surface 220 of the first wall 201. The discharge pressure apply hole 228 may communicate with the discharge space D. The discharge pressure apply hole 228 may be defined in an approximately central portion of the top surface 220, and a plurality of the intermediate discharge hole 240 may be disposed to surround the discharge pressure apply hole 228.

For example, when the scroll compressor 100 is stopped, a pressure within the compression chamber may be relatively lowered. Thus, the refrigerant may flow backward from the discharge space D to the discharge hole 145. In this case, the pressure applied to the discharge pressure apply hole 228 may be greater than the pressure of the discharge hole 145. Thus, a downward pressure may be applied to a top surface of the switching device 300. As a result, the switching device 300 may be spaced apart from the top surface 220 to move downward, thereby closing the discharge hole 145.

On the other hand, when the scroll compressor 100 operates to press the refrigerant in the compression chamber, a pressure of the discharge hole 145, through which the pressed refrigerant may be discharged, may be greater than the pressure within the discharge space D. In this case, an upward pressure may be applied to a bottom surface of the switching device 300. Thus, the switching device 300 may open the discharge hole 145 while moving upward and then move to a position adjacent to the top surface 220, for example, a position that contacts the top surface 220.

The switching device 300 may move upward up to a position adjacent to a bottom surface of the top surface 220. For example, the switching device 300 may move upward until the switching device 300 contacts the bottom surface of the top surface 220.

When the discharge hole 145 is opened, the refrigerant discharged from the discharge hole 145 may flow toward the cover 105 via the intermediate discharge hole 240, and then may be discharged outside of the compressor 100 through the discharge port 103 via the discharge hole 105*a*.

The switching device 300 may include a body 310 having an outer circumferential surface with an approximately cylindrical shape, an opposite surface 320 that defines a top surface of the body 310 and disposed opposite to the discharge pressure apply hole 228, and a recess 330 recessed downward from the opposite surface 320. That is, one surface of the recess 330 may define a surface that is lower than the opposite surface 320. When the recess 330 is defined, and thus, the switching device 300 may move upward to contact a bottom surface of the top surface 220, an area between the opposite surface 320 of the switching device 300 and the top surface 220 may be reduced.

Oil may exist between the third wall 230 and the switching device 300. As described above, the oil may be transferred upward by the oil supply passage 116*a* of the rotational shaft 116, and then, may be supplied to the back pressure portion 200.

The oil may have a predetermined viscosity to form an oil film in a space between the third wall 230 and the switching device 300. The oil film may allow the switching device 300 to adhere to the third wall 230.

In a state in which the switching device 300 moves upward to open the discharge hole 145, when operation of the compressor 100 is stopped, the switching device 300 may have to quickly move downward due to the above-described effect. However, if the switching device 300 does not quickly move downward due to the viscosity of the oil, the refrigerant may flow backward into a space between the orbiting wrap 134 and the fixed wrap 144 through the discharge hole 145, causing reverse rotation of the orbiting scroll 130.

Thus, in this embodiment, the recess 330 may be defined in at least one surface of the switching device 300 to reduce a contact area between the switching device 300 and the top surface 220, to thereby prevent restriction in movement of the switching device 300, due to the viscosity of the oil, from occurring. That is, reliability of the switching device 300 may be improved. Thus, the recess 330 may be referred to as an "adhesion preventer".

The recess 330 may have a width or diameter a greater than a width or diameter b of the discharge pressure apply hole 228. Thus, a contact area between the opposite surface 320 and the top surface 220 may be reduced by the difference in width or diameter. Also, a pressure of the external refrigerant may be uniformly applied to the recess 330 from the discharge pressure apply hole 228, and thus, the switching device 300 may easily move.

If the recess has the width or diameter a less than the width or diameter b of the discharge pressure apply hole 228, an adhesion area between the opposite surface 320 and the top surface 220 may increase. Also, the refrigerant pressure applied to the recess 300 may be non-uniform, and thus, an intensity of the refrigerant pressure applied from outside may be different according to a position of the opposite surface 320. Thus, a moment may occur on the switching device 330 restricting downward quick movement of the switching device 330. Thus, in this embodiment, the recess 330 has the width or diameter a greater than the width or diameter b of the discharge pressure apply hole 228, allowing the switching device 330 to quickly move downward.

The back pressure portion 200 may further include a protrusion 225 disposed to surround the discharge pressure apply hole 228. The protrusion 225 may protrude upward from the top surface 220, and thus, an upper end of the protrusion 225 may be disposed at a position that is higher than the position of the top surface 220. That is, the discharge pressure apply hole 228 may be defined inside the protrusion 225.

While the refrigerant is discharged to an upper side of the top surface 220 through the intermediate discharge hole 240 when the compressor 100 operates, a flow of the refrigerant toward the discharge pressure apply hole 228 may be restricted by the protrusion 225. That is, a structure higher than the top surface 220 may be disposed around the discharge pressure apply hole 228 to prevent the high-pressure discharge refrigerant from being introduced into the discharge pressure apply hole 228. The protrusion 225 may be referred to as a "flow restrictor" in that the protrusion 225 restricts a flow of the refrigerant discharged from the intermediate discharge hole 240 into the discharge pressure apply hole 228.

If the high-pressure refrigerant discharged from the intermediate discharge hole 240 is introduced into the discharge pressure apply hole 228, noise may occur. In addition, a pressure may be applied to the switching device 300 to allow the switching device 300 to move downward. When the switching device 300 moves downward during the operation of the compressor, the discharge of the refrigerant through the discharge hole 145 may be restricted, deteriorating operation efficiency of the compressor. In this embodiment, the protrusion 225 may be provided to prevent the refrigerant from being introduced into the discharge pressure apply hole 228.

The back pressure portion 200 may include one or more step 215 disposed at a portion at which the first wall 201 and the support 210 are connected to each other. The refrigerant discharged from the discharge hole 145 may reach a space defined by the step 215, and then, may flow to the intermediate discharge hole 240.

The second wall 205 may be spaced a predetermined distance from the first wall 201 to surround the first wall 201. A sealing groove 206, in which a first O-ring 227 may be disposed, may be defined in an inner circumferential surface of the second wall 205.

The back pressure portion 200 may form a space having an approximately U-shaped cross-section formed by the first wall 201, the second wall 205, and the support 210. The floating plate 160 may be disposed in the space. An inner space of the space, which may be covered by the floating plate 160, may define the back pressure chamber BP. On the other hand, a space defined by the first and second walls 201 and 205 of the back pressure portion 200, the support 210, and the floating plate 160 may be defined the back pressure chamber BP.

The floating plate 160 may have an annular plate shape and include an inner circumferential surface that faces the outer circumferential surface of the first wall 201 and an outer circumferential surface that faces the inner circumferential surface of the second wall 205. That is, the inner circumferential surface of the floating plate 160 may be disposed to contact the outer circumferential surface of the first wall 201, and the outer circumferential surface of the floating plate 160 may be disposed to contact the inner circumferential surface of the second wall 205.

O-rings 227 and 161 may be disposed on or at contact portions between the floating plate 160 and the first and second walls 201 and 205, respectively. In detail, the O-rings 227 and 161 may include a first O-ring 227 disposed on or at the contact portion between the inner circumferential surface of the second wall 205 and the outer circumferential surface of the floating plate 160, and a second O-ring 161 disposed on or at the contact portion between the outer circumferential surface of the first wall 201 and the inner circumferential surface of the floating plate 160. For example, the first O-ring 227 may be disposed on the inner circumferential surface of the second wall 205, and the second O-ring 161 may be disposed on the inner circumferential surface of the floating plate 160. Leakage through the contact surfaces between the first and second walls 201 and 205 and the floating plate 160, that is, refrigerant leakage from the back pressure chamber BP may be prevented by the O-rings 227 and 161.

A rib 164 that extends upward may be disposed on a top surface of the floating plate 160. For example, the rib 164 may extend upward from the inner circumferential surface of the floating plate 160.

The rib 164 may be movably disposed to selectively contact a bottom surface of the cover 105. When the rib 164 contacts the cover 105, the suction space S and the discharge space D may be partitioned. On the other hand, when the rib 164 is spaced from the bottom surface of the cover 105, that is, when the rib 164 moves in a direction away from the cover 105, the suction space S and the discharge space D may communicate with each other.

In detail, while the scroll compressor 100 operates, the floating plate 160 may move upward to allow the rib 164 to contact the bottom surface of the cover 105. Thus, the rib may serve as a sealing member so that the refrigerant discharged from the discharge hole 145 to pass through the intermediate discharge hole 240 does not leak into the suction space S, but rather, is discharged into the discharge space D.

On the other hand, when the scroll compressor 100 stops, the floating plate 160 may move downward to allow the rib 164 to be spaced apart from the bottom surface of the cover 105. Thus, the discharged refrigerant disposed at the cover-side may flow toward the suction space S through the space between the rib 164 and the cover 105.

Figure 5:
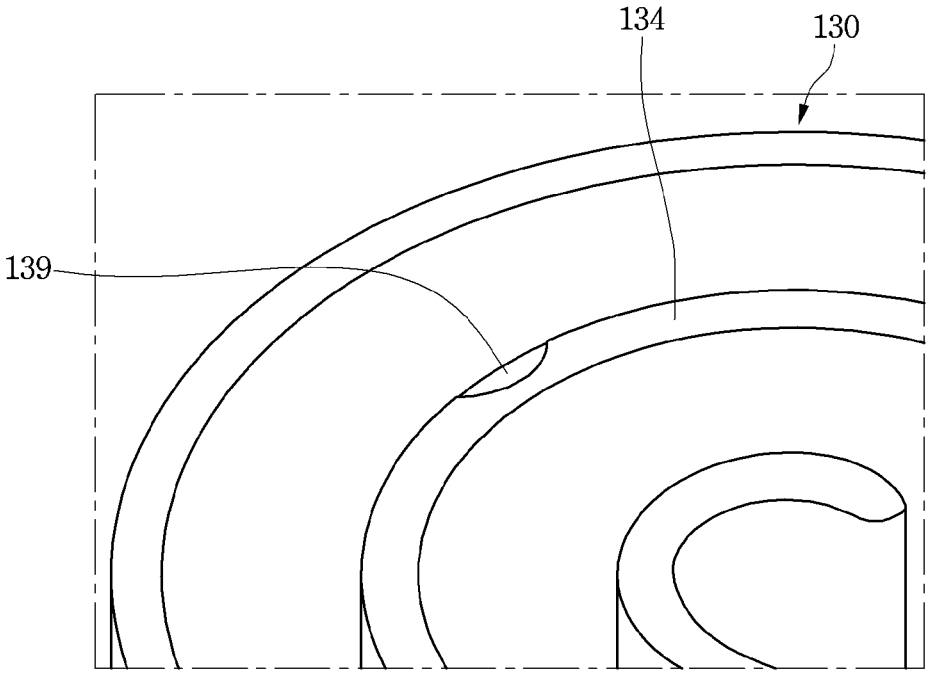
FIG. 5 is a view illustrating a portion of components of an orbiting scroll of the scroll compressor of FIG. 1.
Figure 6:
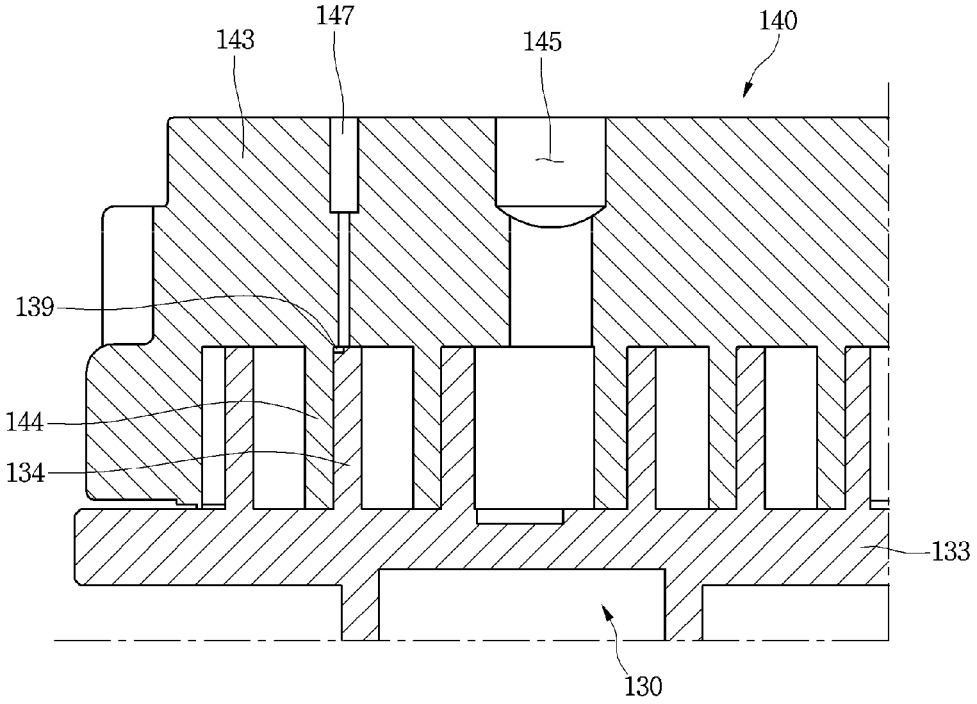
FIG. 6 is a cross-sectional view illustrating a coupled state of the fixed scroll and the orbiting scroll of the scroll compressor of FIG. 1.
Figure 7:
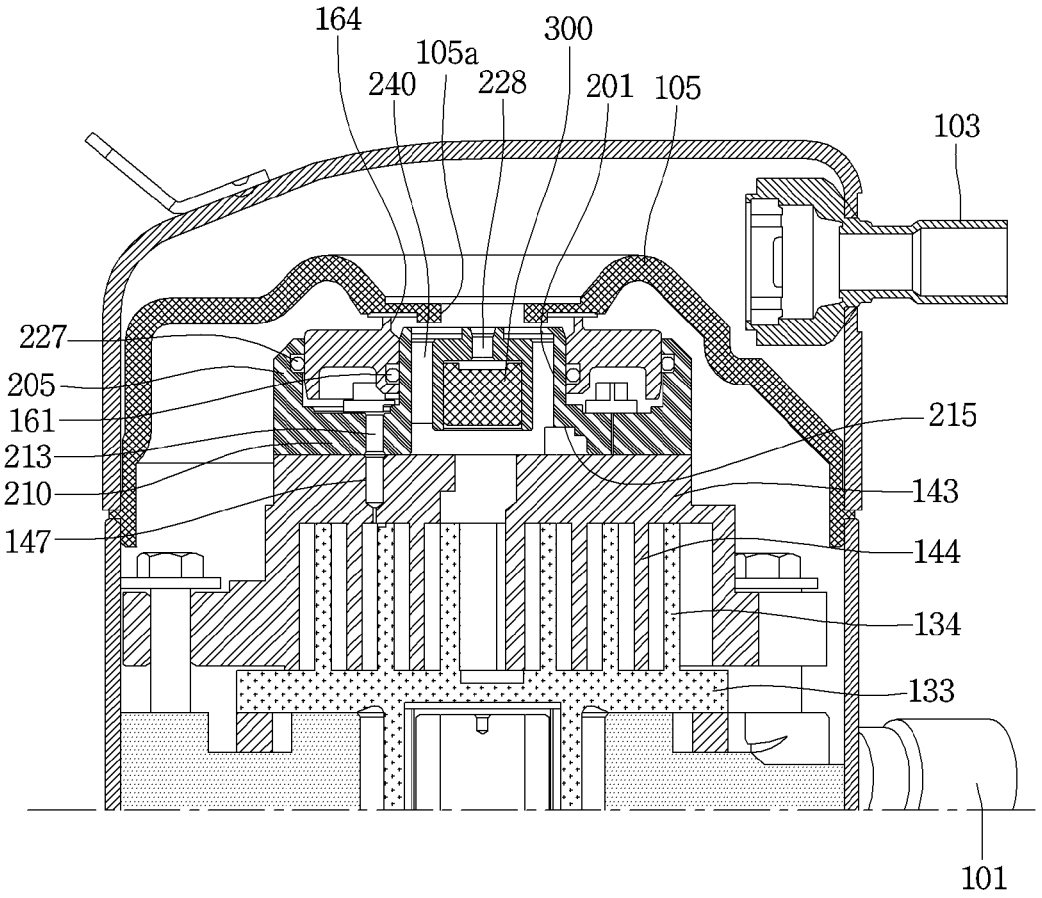
FIG. 7 is a partial cross-sectional view of the scroll compressor of FIG. 1.

FIG. 5 is a view illustrating a portion of components of the orbiting scroll of the scroll compressor of FIG. 1. FIG. 6 is a cross-sectional view illustrating a coupled state of the fixed scroll and the orbiting scroll of the scroll compressor of FIG. 1. FIG. 7 is a partial cross-sectional view of the scroll compressor of FIG. 1.

Referring to FIGS. 5 and 7, the orbiting scroll 130 according to this embodiment may include a discharge guide 139 that guides the refrigerant flowing into the intermediate pressure discharge hole 147 so that the refrigerant may be introduced into a space (region) having a pressure less than the pressure of the back pressure chamber BP. In detail, when the operation of the scroll compressor 100 stops, the compression chamber defined by the orbiting wrap 134 and the fixed wrap 144 may vanish, and thus, the refrigerant may flow into the space (region) between the orbiting wrap 134 and the fixed wrap 144. The space (region) may have a pressure less than the pressure of the back pressure chamber BP. The space (region) may be referred to as a "wrap space".

The discharge guide 139 may be recessed from an end surface of the orbiting wrap 134 of the orbiting scroll 130. Thus, the discharge guide 139 may be referred to as a "guide recess". The end surface of the orbiting wrap 134 may refer to a surface of the orbiting wrap 134 that faces the fixed head plate 143 of the fixed scroll 140 or a surface of the orbiting wrap 134 that contacts the fixed head plate 143.

A width of the end surface of the orbiting wrap 134, that is, a thickness of the orbiting wrap 134 may be greater than a width of the intermediate pressure discharge hole 147. Also, the discharge guide 139 may be recessed from the end surface of the orbiting wrap 134 by a preset or predetermined width and depth, which will be described hereinbelow.

While the orbiting scroll 130 revolves, the orbiting wrap 134 may be disposed directly below the intermediate pressure discharge hole 147 or be disposed to be spaced horizontally from a lower end of the intermediate pressure discharge hole 147 to open the intermediate pressure discharge hole 147. If the discharge guide 139 is not provided, when the orbiting wrap 134 is disposed directly below the intermediate pressure discharge hole 147 (see FIG. 6), the orbiting wrap 134 may cover the intermediate pressure discharge hole 147. On the other hand, when the orbiting wrap 134 moves horizontally by a predetermined distance, at least a portion of the intermediate pressure discharge hole 147 may be opened.

Also, while the scroll compressor 100 operates, when the intermediate pressure discharge hole 147 is opened, the intermediate pressure refrigerant of the compression chamber may be introduced into the back pressure chamber BP through the intermediate pressure discharge hole 147. On the other hand, in a state in which the scroll compressor 100 stops, when the orbiting wrap 134 is disposed directly below the intermediate pressure discharge hole 147 to block the intermediate pressure discharge hole 147, the refrigerant of the back pressure chamber BP may not be introduced into the wrap space through the intermediate pressure discharge hole 147. As a result, an equilibrium pressure may not be maintained, and thus, quick re-operation of the compressor may be limited.

In detail, when the operation of the scroll compressor 100 is stopped, the pressure within the scroll compressor may converge to a predetermined pressure (the equilibrium pressure). The equilibrium pressure may be a pressure slightly higher than a suction-side pressure. That is, the refrigerant of the compression chamber and the discharge-side refrigerant may be discharged, and the inside of the compressor may converge to the equilibrium pressure. Then, when the scroll compressor 100 operates again, the scroll compressor 100 may operate while a difference between the equilibrium pressure and a pressure at each position occurs.

It may be necessary to maintain the equilibrium pressure while the refrigerant of the back pressure chamber BP is discharged to the suction-side. If the refrigerant of the back pressure chamber BP is not discharged, the fixed scroll 140 may be compressed downward by the pressure of the back pressure chamber BP, and thus, may be maintained in a state in which the fixed scroll 140 is closely attached to the orbiting scroll 130.

Also, if the refrigerant of the back pressure chamber BP is not discharged, the pressure of the back pressure chamber BP may be maintained at the equilibrium pressure. Accordingly, the floating plate 160 may move upward to contact the cover 105. As a result, the discharge passage for the discharge-side refrigerant may be blocked, preventing the discharge-side refrigerant from being discharged to the suction-side of the scroll compressor 100, thereby further pressing the fixed scroll 140 downward.

As described above, when the fixed scroll 140 is pressed to maintain the state in which the fixed scroll 140 is closely attached to the orbiting scroll 130 at a pressure greater than a predetermined pressure, it may be difficult to quickly drive the scroll compressor 100 again. Thus, embodiments disclosed herein may have a feature in which the discharge guide 139 is disposed in the orbiting wrap 134 to prevent the intermediate pressure discharge hole 147 from being completely covered or shielded, and thus, even though the orbiting wrap 134 is disposed directly below the intermediate pressure discharge hole 147, the intermediate pressure discharge hole 147 and the compression chamber (when the compressor operates) or the intermediate pressure discharge hole 147 and the wrap space (when the compressor stops) may communicate with each other.

Figure 8:
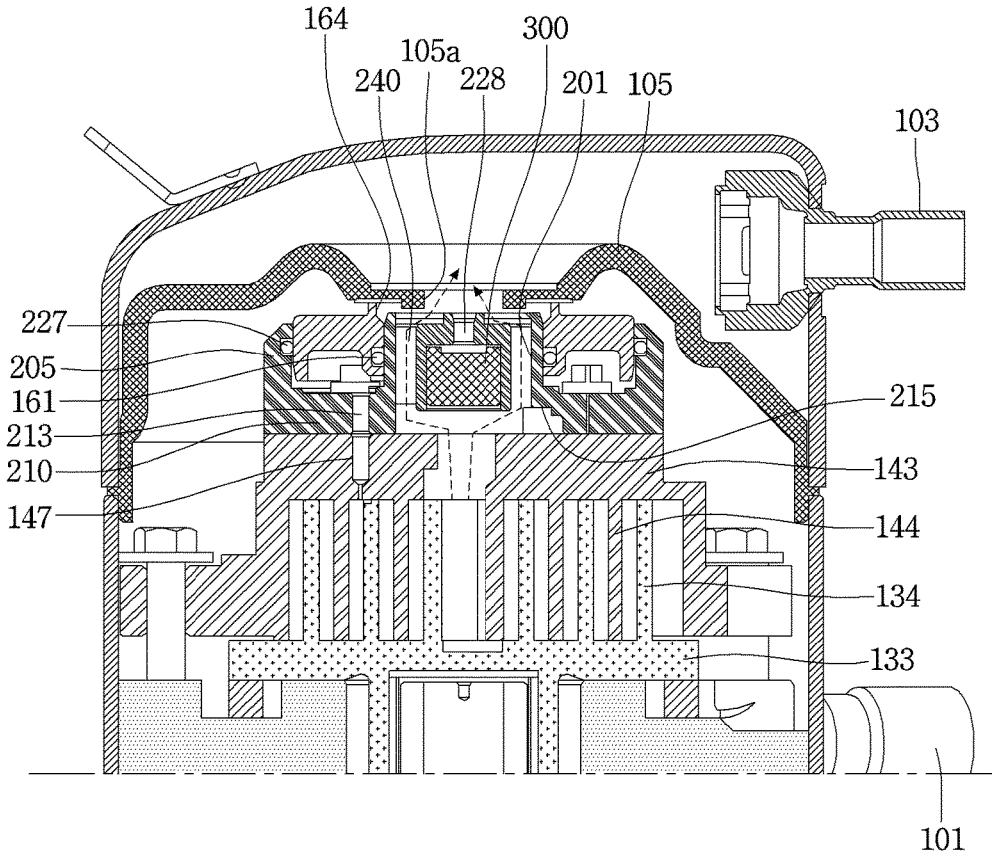
FIG. 8 is a cross-sectional view illustrating a flow of refrigerant when the scroll compressor of FIG. 1 operates.
Figure 9:
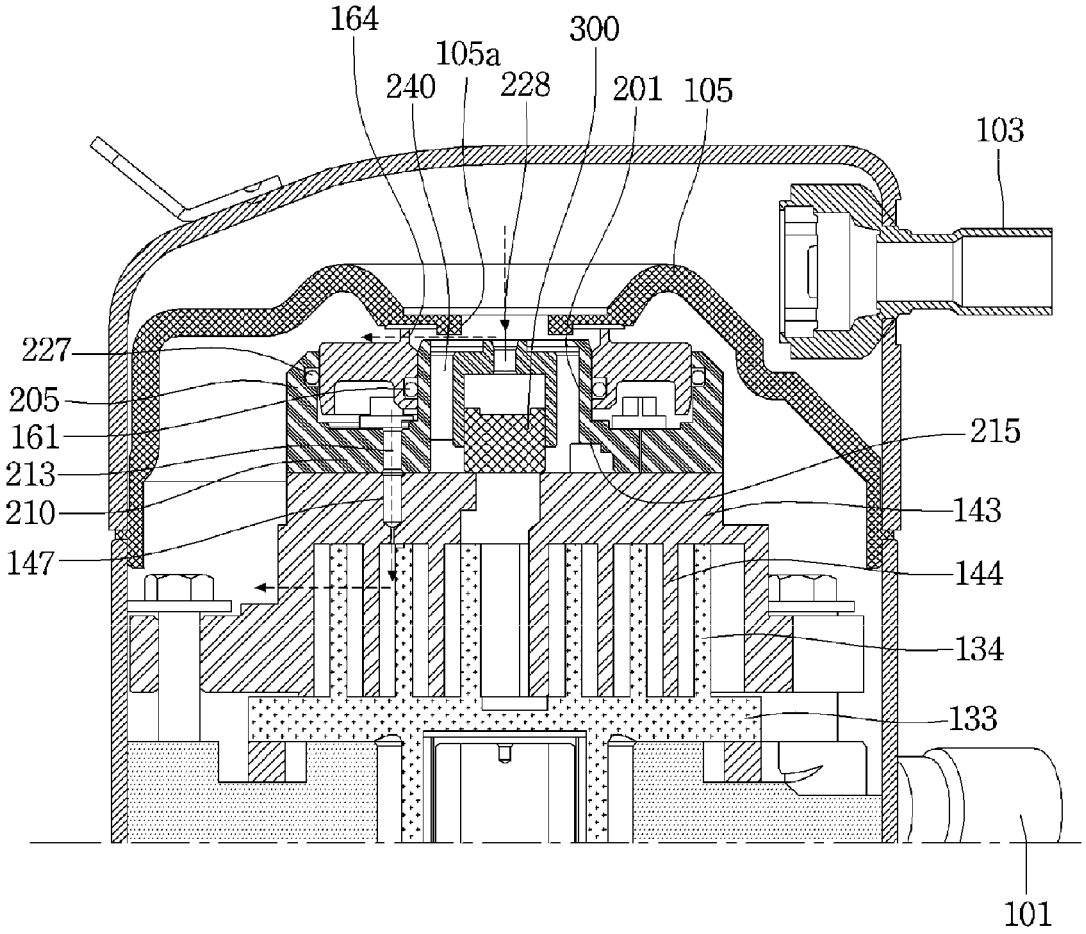
FIG. 9 is a cross-sectional view illustrating a flow of the refrigerant when the scroll compressor of FIG. 1 is stopped.

FIG. 8 is a cross-sectional view illustrating a flow of refrigerant when the scroll compressor of FIG. 1 operates. FIG. 9 is a cross-sectional view illustrating a flow of the refrigerant when the scroll compressor of FIG. 1 is stopped.

Referring to FIGS. 8 and 9, when the scroll compressor 100 operates or stops, effects according to this embodiment, that is, a flow of the refrigerant will be described hereinbelow. Referring to FIG. 8, in a case in which the scroll compressor 100 according to this embodiment operates, when power is applied to the stator 112, the rotational shaft 116 may be rotated by the stator 112 and the rotor 114. As the rotational shaft 116 rotates, the orbiting scroll 130 coupled to the rotational shaft 116 revolves with respect to the fixed scroll 140. As a result, the plurality of compression chambers formed between the fixed wrap 144 and the orbiting wrap 134 may move toward the discharge hole 145 to compress the refrigerant. Oil stored in the oil storage space may be transferred upward by the oil supply passage 116*a* defined in the rotational shaft 116 and uniformly supplied to components within the casing 110, for example, the fixed scroll 140, the orbiting scroll 130, the back pressure portion 200, and the floating plate 160.

The fixed wrap 144 and the orbiting wrap 134 may be closely attached to each other in a radial direction, that is, a direction perpendicular to the rotational shaft 116 to form the plurality of compression chambers. The plurality of compression chambers may be sealed by adhesion between the wraps 134 and 144 to prevent the refrigerant from leaking in the radial direction.

While the refrigerant is compressed, at least a portion of the refrigerant within the compression chamber having the intermediate pressure may be introduced into the back pressure chamber BP through the intermediate pressure discharge hole 147 of the fixed scroll 140 and the intermediate pressure suction hole 213 of the back pressure portion 200. Even though the orbiting wrap 134 of the orbiting scroll 130 is disposed directly below the intermediate pressure discharge hole 147 to contact the intermediate pressure discharge hole 147, as the intermediate pressure discharge hole 147 and the compression chamber communicate with each other due to the discharge guide 139, the refrigerant may flow into the intermediate pressure discharge hole 147. Also, as the intermediate pressure discharge hole 147 and the back pressure chamber BP communicate with each other, the refrigerant flowing through the intermediate pressure discharge hole 147 may be easily introduced into the back pressure chamber BP.

Thus, the back pressure chamber BP may have the intermediate pressure between the suction pressure and the discharge pressure. As described above, as the back pressure chamber BP has the intermediate pressure, a downward force may be applied to the back pressure portion 200, and an upward force may be applied to the floating plate 160.

As the back pressure portion 200 is coupled to the fixed scroll 140, the intermediate pressure of the back pressure chamber BP may have an influence on the fixed scroll 140. However, as the fixed scroll 140 is in contact with the orbiting head plate 133 of the orbiting scroll 130, the floating plate 160 may move upward due to the reaction thereof. As the floating plate 160 moves upward, the rib 164 of the floating plate 160 may move upward until the rib 164 contacts the bottom surface of the cover 105.

Also, the pressure of the back pressure chamber BP may compress the fixed scroll 140 toward the orbiting scroll 130 to prevent the refrigerant from leaking between the orbiting scroll 130 and the fixed scroll 140. The fixed wrap 144 and the orbiting head plate 133 and the orbiting wrap 134 and the fixed head plate 143 may be closely attached to each other in an axial direction, that is, a direction parallel to the rotational shaft 116 to form the plurality of compression chambers. The plurality of compression chambers may be sealed by adhesion between the wraps 134 and 144 and the head plates 133 and 143 to prevent the refrigerant from leaking in the axial direction. The refrigerant of the compression chamber may flow to the intermediate discharge hole 240 of the back pressure portion 200 through the discharge hole 145, and then, may be discharged outside of the scroll compressor 100 from the discharge port 103 via the discharge hole 105*a* of the cover 105.

The switching device 300 may be in a state in which the switching 300 is moved upward along the third wall 230 by the refrigerant having the discharge pressure. Thus, the discharge hole 145 may be opened. That is, as the pressure of the discharge hole 145 is greater than the pressure of the discharge space D, the switching device 300 may be moved upward.

As described above, as the rib 164 contacts the bottom surface of the cover 105 to block the passage between the floating plate 160 and the cover 105, the refrigerant passing through the intermediate discharge hole 240 may not flow toward the suction space S through the passage to pass through the discharge hole 105*a* of the cover 105. The introduction of the refrigerant from an outlet of the intermediate discharge hole 240 to the discharge pressure apply hole 228 may be restricted by the protrusion 225. Also, the refrigerant may be guided to the discharge hole 105*a* along the protrusion 225. That is, the protrusion 225 may function as a blocking wall for the refrigerant flowing toward the discharge pressure apply hole 228 to prevent noise from occurring due to the introduction of the refrigerant into the discharge pressure apply hole 228 and an abnormal operation of the switching device 300 from occurring.

Next, referring to FIG. 9, in a case of the scroll compressor 100 according to an embodiment, supply of power applied to the stator 112 may be stopped. Thus, rotation of the rotational shaft 116 and revolution of the orbiting scroll 130 may be stopped, stopping a compression operation of the refrigerant. When the compression operation of the refrigerant is stopped, a force that closely attaches the fixed wrap 144 to the orbiting wrap 134, that is, a force that closely attaches the fixed wrap 144 to the orbiting wrap 134 in the radial direction may be relieved or released. Thus, the sealed compression chamber formed by the fixed wrap 144 and the orbiting wrap 134 may vanish.

In detail, the discharge side refrigerant having a relatively high pressure and the refrigerant within the compression chamber may flow toward the suction space S. A pressure of the wrap space formed by the fixed wrap 144 and the orbiting wrap 134 may converge to a predetermined pressure (equilibrium pressure).

When compared to the pressure of the wrap space, the relative pressure of the discharge space D may temporarily increase. The switching device 300 may move downward to block the discharge hole 145. Thus, it may prevent the refrigerant of the discharge space D from flowing backward to the wrap space through the intermediate discharge hole 240 and the discharge hole 145 and prevent the fixed scroll 130 from reversely rotating.

Further, as the recess 330 is defined in the opposite surface 320 of the switching device 300, a contact area between the bottom surface of the top surface 220 and the opposite surface 320 may be reduced. Thus, a viscosity force of oil that acts between the switching device 330 and the top surface 220 may be reduced, and thus, the switching device 330 may quickly move downward.

Furthermore, as the width or diameter a of the recess 330 is greater than the width or diameter b of the discharge pressure apply hole 228, the refrigerant pressure may be smoothly applied from the discharge pressure apply hole 228 to the recess 330. Thus, the switching device 300 may easily move.

As the scroll compressor 100 is stopped, the orbiting wrap 134 may be stopped at a predetermined position. Even though the orbiting wrap 134 is disposed on or at a position at which the intermediate pressure discharge hole 147 is opened, as well as, the orbiting wrap 134 is disposed on or at a position at which the intermediate pressure discharge hole 147 is closed, the refrigerant of the back pressure chamber BP may be bypassed to the wrap space through the discharge guide 139.

That is, the refrigerant of the back pressure chamber BP may be introduced into the wrap space through the intermediate pressure suction hole 213 and the intermediate pressure discharge hole 147 to flow into the suction space S. Also, the back pressure chamber BP may be maintained at the equilibrium pressure by the flow of the refrigerant.

As the back pressure chamber BP is maintained at the equilibrium pressure, the floating plate 160 may move downward, and thus, the rib 164 may be spaced apart from the bottom surface of the cover 105. Thus, the passage between the floating plate 160 and the cover 105 may be opened. As a result, the refrigerant of the cover 105 or the discharge space D may flow toward the suction space S through the passage.

As described above, as the refrigerant of the back pressure chamber BP may be introduced into the wrap space through the discharge guide 139 of the orbiting wrap 134, the back pressure chamber BP may be maintained at the equilibrium pressure. Also, the rib 164 may be spaced apart from the cover 105 to open the passage of the refrigerant. As a result, as the pressure of the cover 105 or the discharge space D may be maintained at the equilibrium pressure, the compressor 100 may quickly re-operate when the compressor 100 re-operates.

If the refrigerant of the back pressure chamber BP is not introduced into the wrap space to allow the back pressure chamber BP to be maintained at the intermediate pressure, and also the rib 164 is maintained in contact with the cover 105, and thus, the pressure of the cover 105 and the discharge space D is not maintained at the equilibrium pressure, the fixed scroll 140 and the orbiting scroll 130 may be closely attached to each other at an excessive pressure. As a result, it may be difficult to quickly drive the compressor again. However, this embodiment may solve the above-described limitation.

A check valve (not shown) may be disposed in the discharge port 103. Thus, when the operation of the scroll compressor 100 is stopped, the check valve may be closed to prevent the refrigerant outside of the scroll compressor 100 from being introduced into the casing 110 through the discharge port 103.

Hereinafter, additional embodiments will be described. As the embodiments are similar to the previous embodiment except for only certain portions or components, different points therebetween will be described principally, and descriptions of similar or the same components will be denoted by similar or the same reference numerals and respective description omitted.

Figure 10:
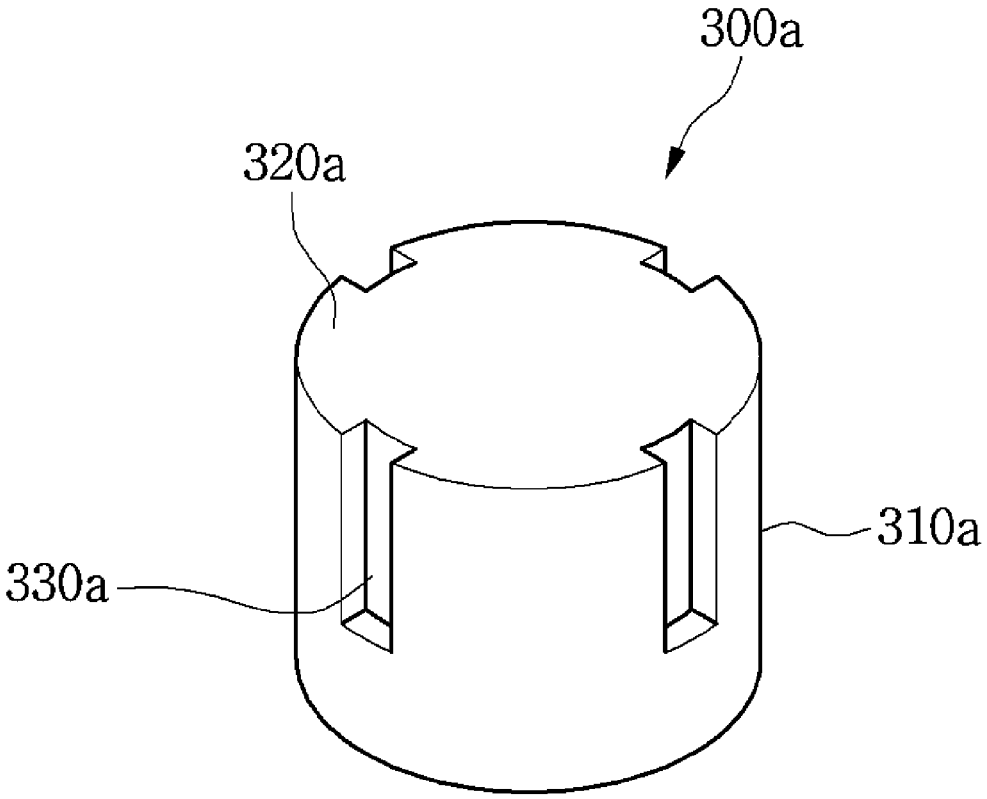
FIG. 10 is a view of a switching device according to another embodiment.

FIG. 10 is a view of a switching device according to another embodiment. Referring to FIG. 10, a switching device 300*a* according to this embodiment may include a body 310*a* having an outer circumferential surface with an approximately cylindrical shape, an opposite surface 320*a* that defines a top surface of the body 310*a* and disposed opposite to discharge pressure apply hole 228, and at least one recess 330*a* recessed from an outer circumferential surface or the opposite surface 320*a*.

The at least one recess 330*a* may be recessed downward from the opposite surface 320*a* and have a predetermined depth. Further, the at least one recess 330*a* may include a plurality of the recess 330*a* disposed along the outer circumferential surface of the body 310*a*.

That is, the recess 330*a* may be recessed from the opposite surface 320*a* to the outer circumferential surface of the body 310*a*. At least a first portion of the recess 330*a* may be recessed from the opposite surface 320*a*, and a second portion may be recessed inward from the outer circumferential surface of the body 310*a*. Thus, a contact area between the switching device 300*a* and the bottom surface of top surface 220, and a contract surface between the switching device 300*a* and third wall 230 may be reduced, preventing movement of the switching device 300*a* from being restricted by viscosity of an oil.

Figure 11:
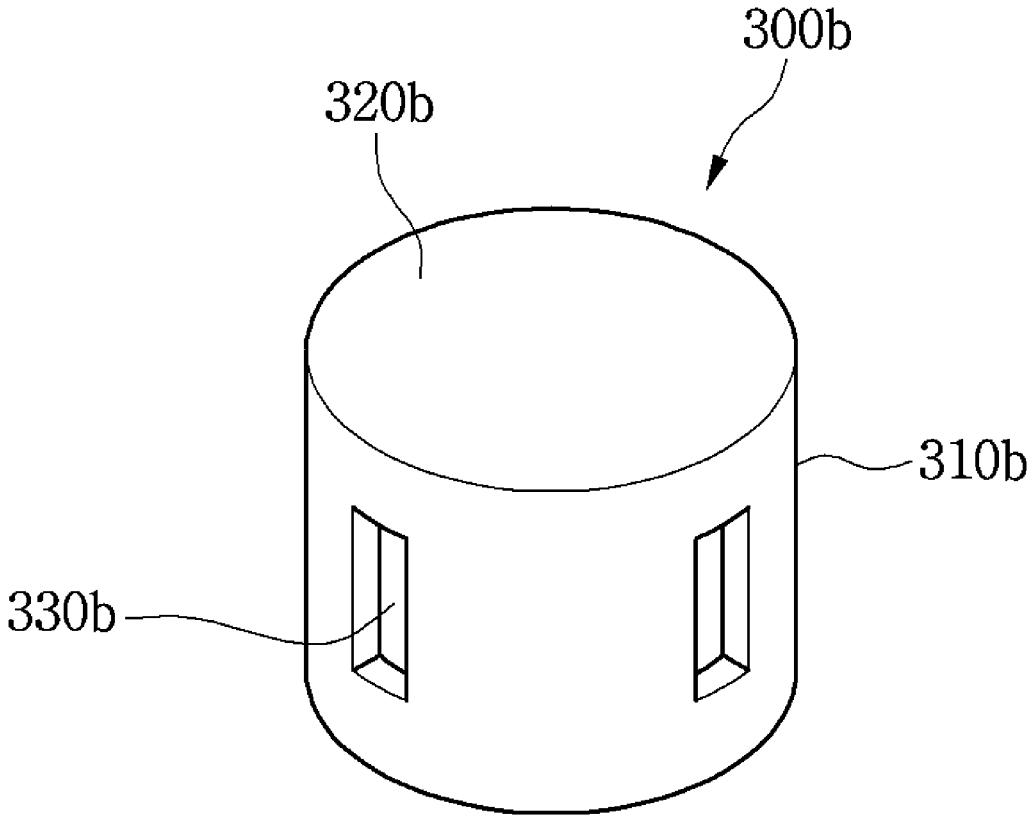
FIG. 11 is a view of a switching device according to still another embodiment.

FIG. 11 is a view of a switching device according to still another embodiment. Referring to FIG. 11, a switching device 300*b* according to this embodiment may include a body 310*b* having an outer circumferential surface with an approximately cylindrical shape, an opposite surface 320*b* that defines a top surface of the body 310*b* and disposed opposite to discharge pressure apply hole 228, and at least one recess 330*b* recessed from an outer circumferential surface of the body 310*b*.

The at least one recess 330*b* may be recessed from the outer circumferential surface of the body 310*b* and be disposed to be spaced downward from the opposite surface 320*b*. Also, the at least one recess 330*b* may include a plurality of the recess 330*b* disposed along the outer circumferential surface of the body 310*b*. Thus, a contact area between the switching device 300*a* and third wall 230 may be reduced, preventing movement of the switching device 300*a* from being restricted by viscosity of an oil.

Figure 12:
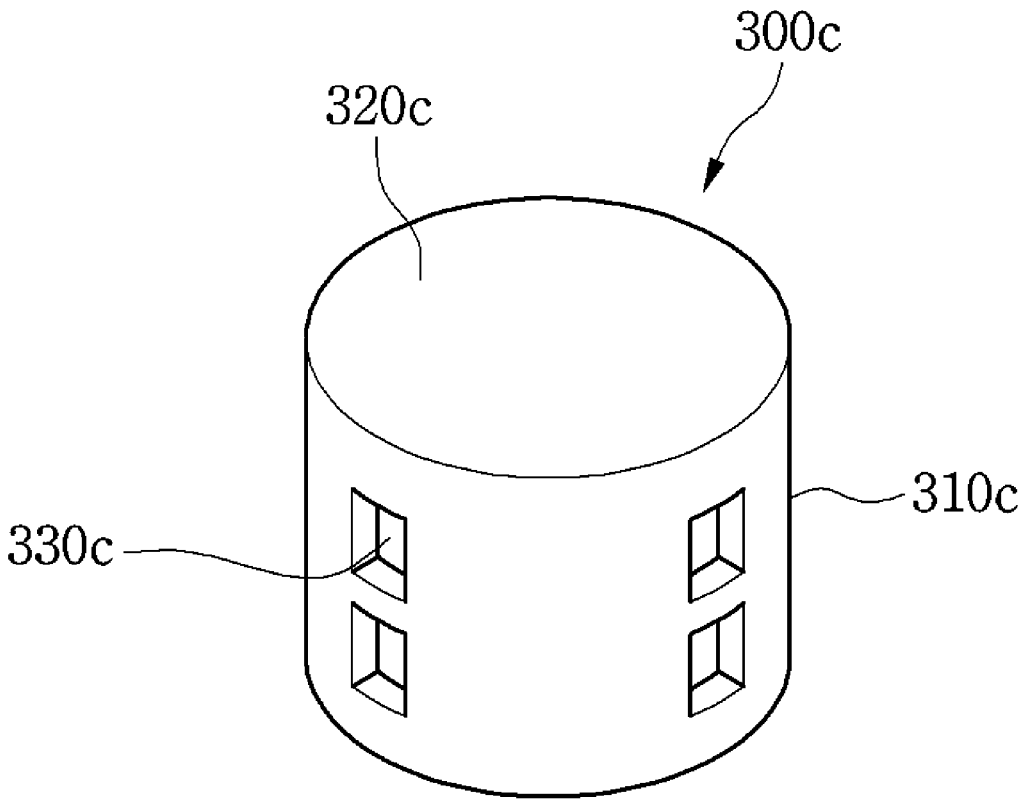
FIG. 12 is a view of a switching device according to still another embodiment.

FIG. 12 is a view of a switching device according to still another embodiment. Referring to FIG. 12, a switching device 300*c* according to this embodiment may include a body 310*c* having an outer circumferential surface with an approximately cylindrical shape, an opposite surface 320*c* that defines a top surface of the body 310*c* and disposed opposite to discharge pressure apply hole 228, and at least one recess 330*c* recessed from an outer circumferential surface of the body 310*c*.

The at least one recess 330*c* may be recessed from the outer circumferential surface of the body 310*c* and be disposed to be spaced downward from the opposite surface 320*c*. Also, the at least one recess 330*c* may include a plurality of the recess 330*c* disposed along the outer circumferential surface of the body 310*c*.

The plurality of recesses 330*c* may be longitudinally spaced apart from each other. That is, according to the previous embodiment, one recess may extend in a longitudinal direction. However, with the recess 330*c* according to this embodiment, the recess 330*c* may be provided as a plurality of the recesses 330*c*, which may be intermittently disposed in the longitudinal direction. Thus, a contact area between the switching device 300*c* and third wall 230 may be reduced, preventing movement of the switching device 300*c* from being restricted by viscosity of an oil.

Figure 13:
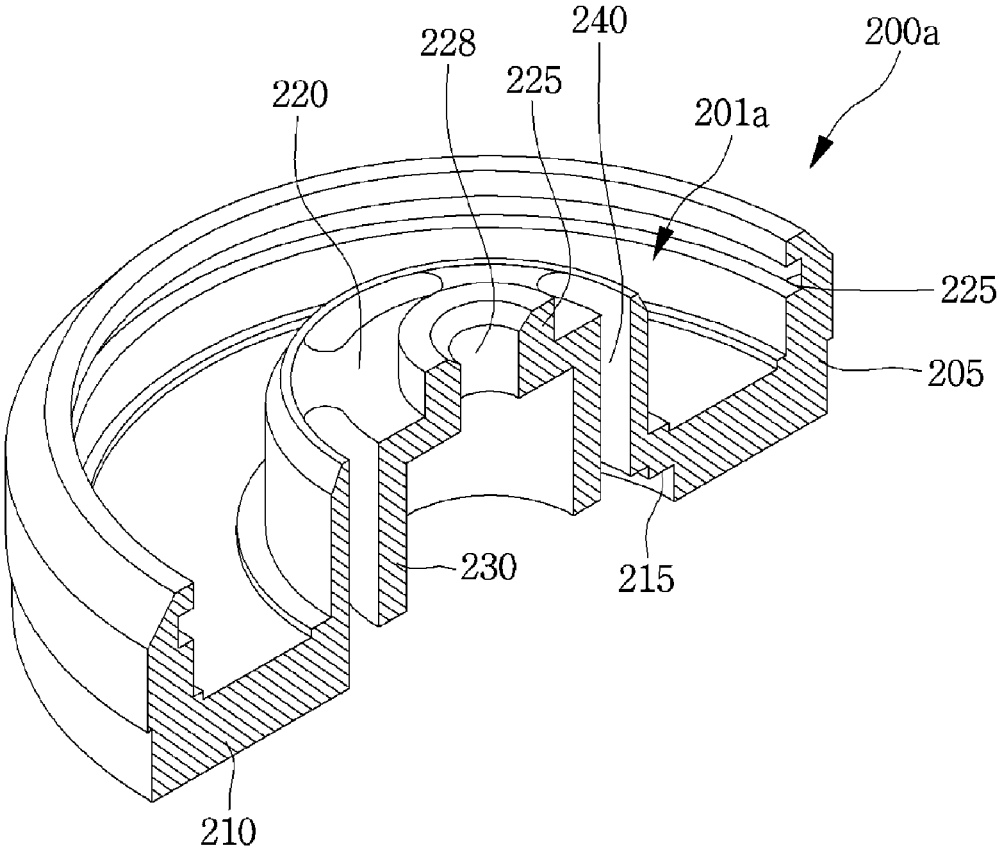
FIG. 13 is a cross-sectional view of a back pressure portion according to another embodiment.

FIG. 13 is a cross-sectional view of a back pressure portion according to a another embodiment. Referring to FIG. 13, back pressure portion 200*a* according to this embodiment may include support 210 having an approximately annular shape with a hollow to contact fixed head plate 143 of fixed scroll 140 and a plurality of walls 201*a* and 205 that extend upward from the support 210.

The plurality of walls 201*a* and 205 may include a first wall 201*a* that extends upward from an inner circumferential surface of the support 210, and second wall 205 that extends upward from an outer circumferential surface of the support 210. Each of the first and second walls 201*a* and 205 may have an approximately cylindrical shape.

An upper end of the first wall 201*a* may be disposed at approximately a same height as top surface 220. On the other hand, with this embodiment, protrusion 225 may be disposed on back pressure portion 200 to surround discharge pressure apply hole 228. Thus, introduction of a refrigerant discharged from an intermediate discharge hole 240 into the discharge pressure apply hole 228 may be restricted.

Although the upper end of the first wall 201*a* may be disposed at the substantially same height as the top surface 220, like the previous embodiment, rib 164 of floating plate 160 may contact cover 105 while the scroll compressor 100 operates to restrict a flow of the high-pressure discharge refrigerant into suction space S. Thus, even though the first wall 201*a* does not extend up to a position that is higher than the top surface 220, the effect that is intended to be achieved may be obtained.

Figure 14:
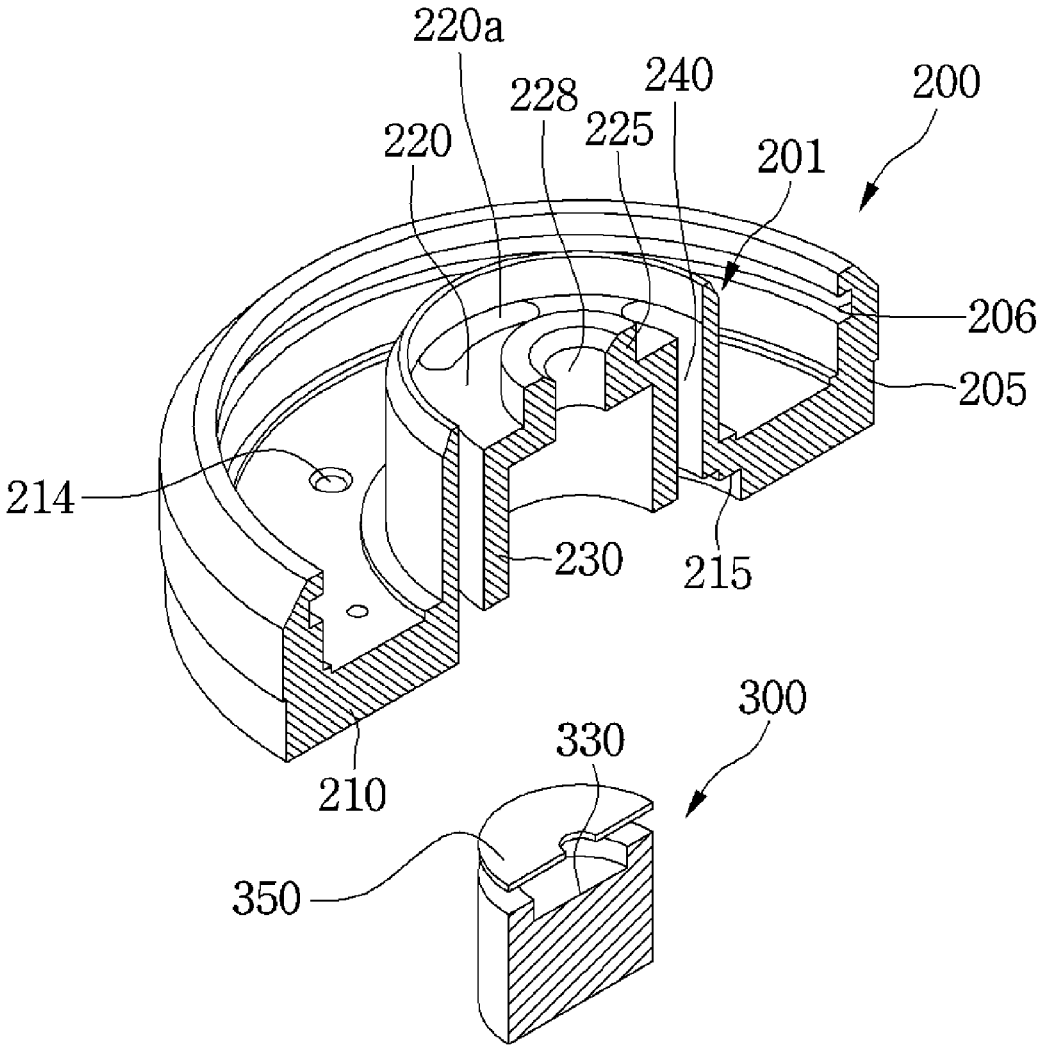
FIGS. 14 to 16 are views of a switching device and a disk according to another embodiment.
Figure 15:
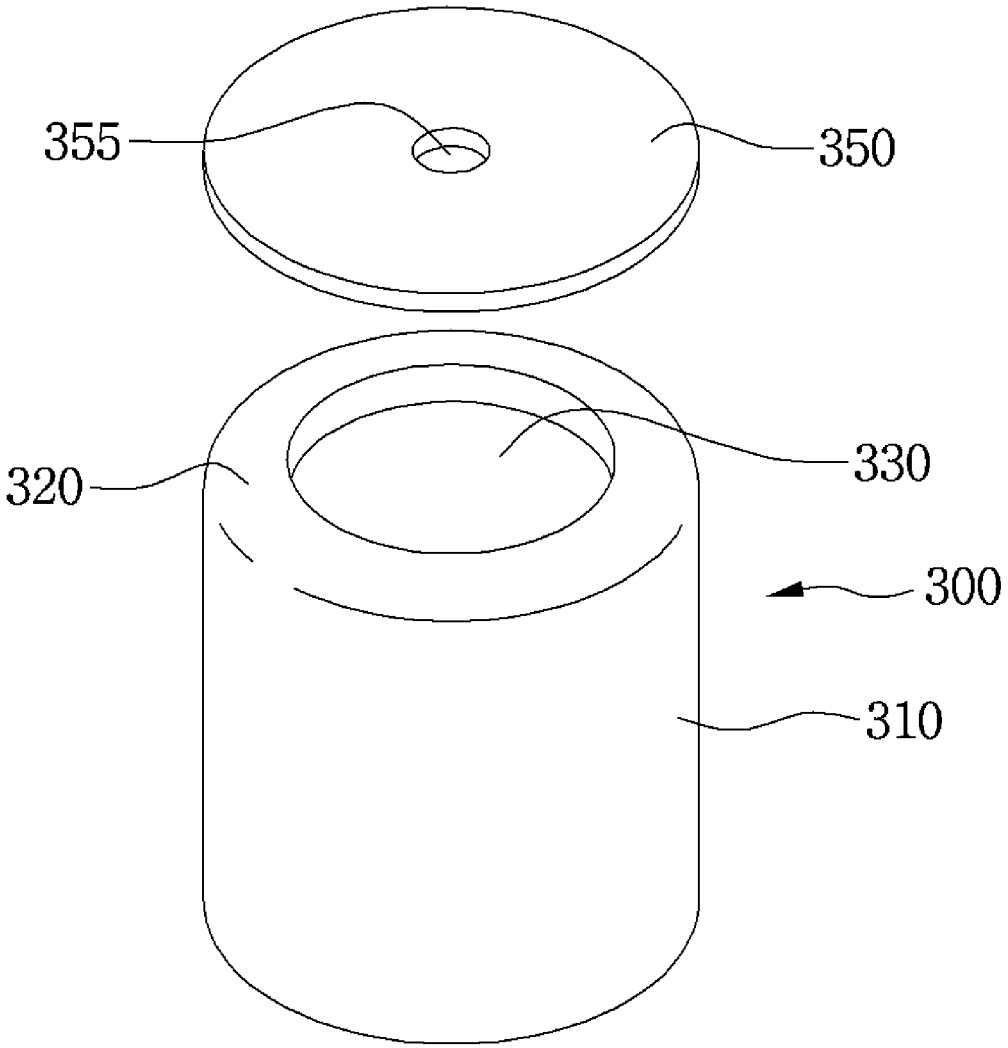
Figure 16:
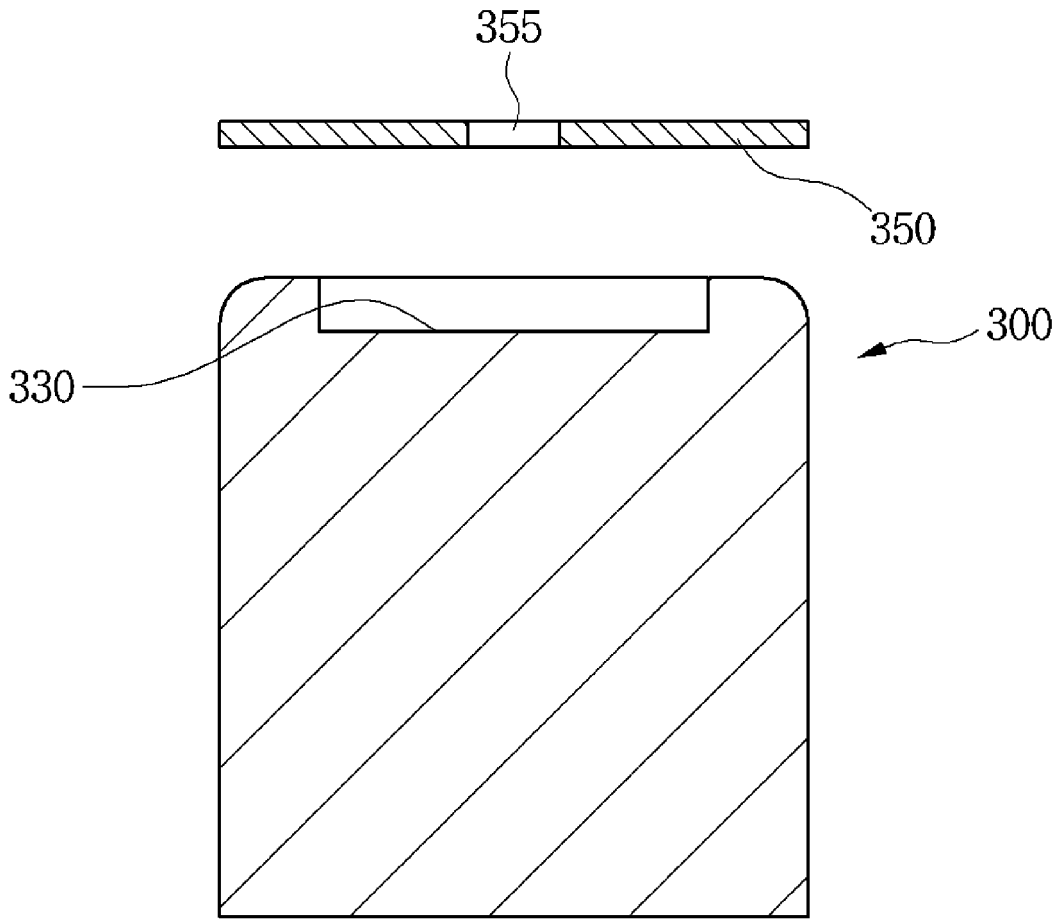

FIGS. 14 to 16 are views of a switching device and a disk according to a another embodiment. Referring to FIGS. 14 to 16, scroll compressor 100 according to this embodiment may include switching device 300 movably disposed inside third wall 230 and a disk 350 disposed between the switching device 300 and top surface 220.

The disk 350 may be disposed movable in a space between a top surface of the switching device 300 and top surface 220. The disk 350 may have a mass less that a mass of the switching device 300. Further, the disk 350 may be maintained in a state in which the disk 350 adheres with a predetermined viscosity by oil existing on an inner surface of the third wall 230 or the top surface 220.

In a state in which the disk 350 is separated from the switching device 300, it may prevent the oil existing on the third wall 230 or the top surface 220 from having a direct effect on the switching device 300. Also, when the switching device 300 moves upward to open discharge hole 145, the disk 350 may function as a "buffer" to buffer an impact applied from the switching device 300 to the top surface 220. Also, noise generated while the switching device 300 operates may be reduced by the buffering function of the disk 350.

The disk 350 may have a through-hole, through which a fluid may pass. For example, through-hole 355 may be defined in an approximately central portion of the disk 350. The disk 350 may have an annular flat plate shape due to the through hole 355.

While the switching device 300 moves upward, a fluid existing between the switching device 300 and the disk 350, for example, a refrigerant or oil may be reduced in volume to pass upward through the through-hole 355. With this process, the switching device 300 may easily approach the disk 350, and the disk 350 may perform the buffer function for the switching device 300. If the through-hole 355 is not provided, the switching device 300 may not smoothly move by a pressure applied between the switching device 300 and the disk 350, and also, the buffer function of the disk 350 for the switching device 300 may not be easily performed.

Figure 17:
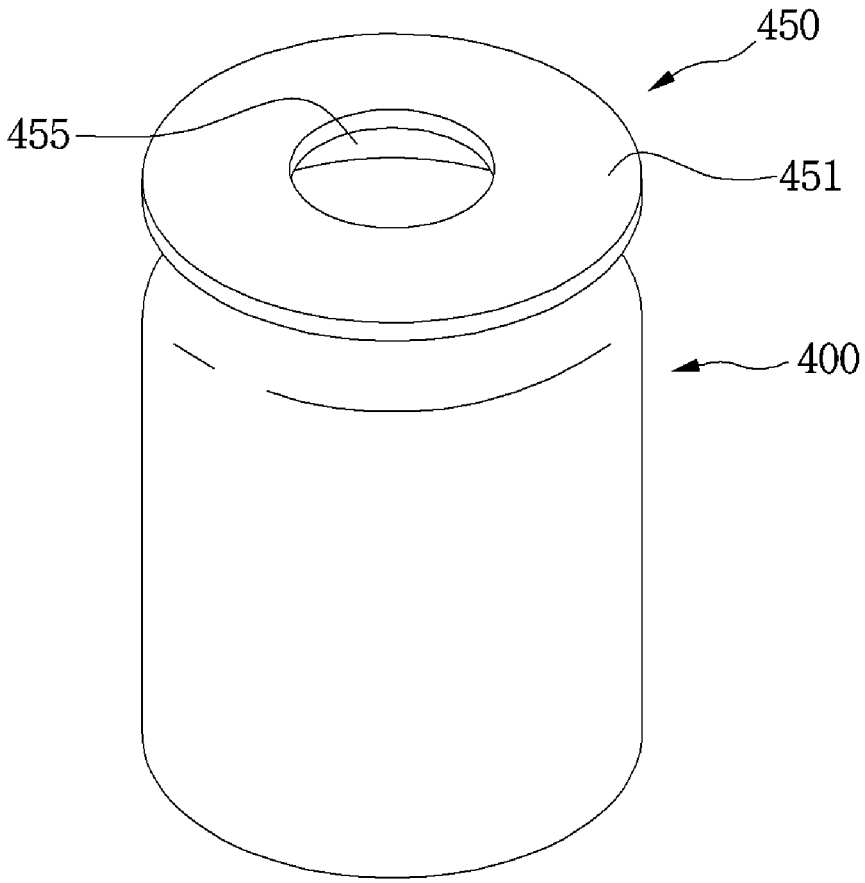
FIGS. 17 and 18 are views of a switching device and a disk according to still another embodiment.
Figure 18:
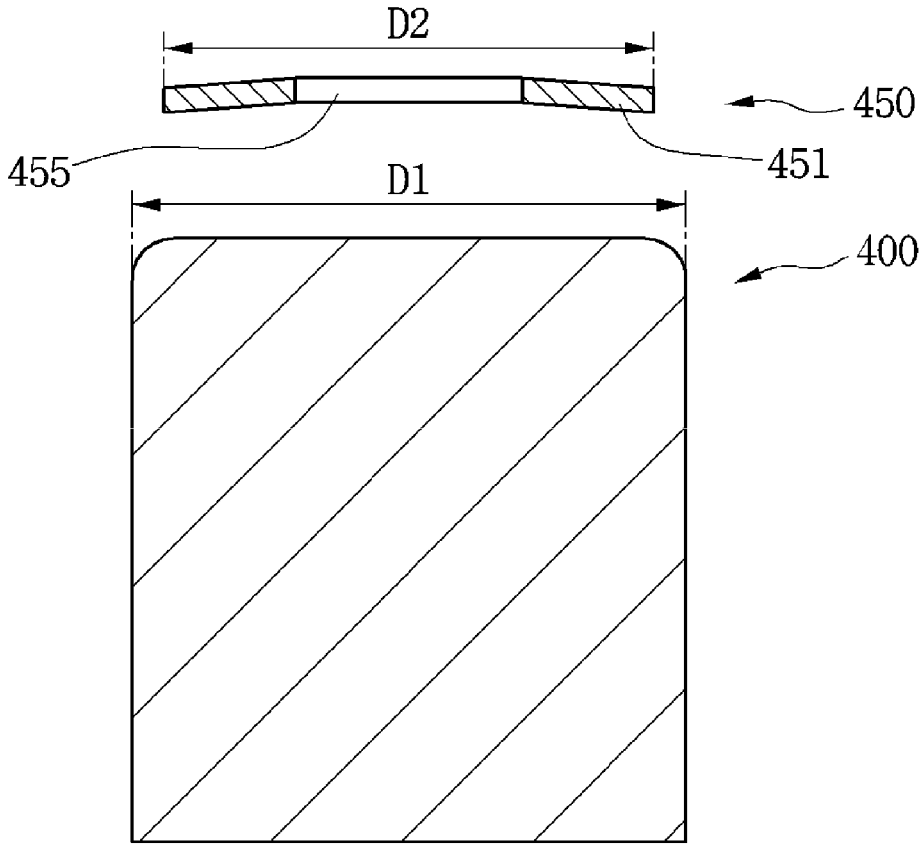

FIGS. 17 and 18 are views of a switching device and a disk according to still another embodiment. Referring to FIGS. 17 to 18, scroll compressor 100 according to this embodiment may include a switching device 400 movably disposed inside third wall 230, and a disk 450 disposed between the switching device 400 and top surface 220.

The switching device 400 may have a cylindrical shape. The switching device 400 may selectively open the discharge hole 145 and be vertically movable.

The disk 450 may be disposed movable in a space between a top surface of the switching device 400 and the top surface 220. The disk 450 may include a main body 451 having an inclined surface, and a through-hole 455, through which at least a portion of the main body 451 may pass. The through-hole 455 may be defined in an approximately central portion of the main body 451. The main body 451 may have an annular plate shape having the inclined surface and the through-hole 455.

The inclined surface of the main body 451 may be inclined upward from an outer circumferential surface of the main body 451 to the through-hole 455. That is, the inclined surface of the main body 451 may be inclined downward from the through-hole 455 to the outer circumferential surface of the main body 451.

Also, the inclined surface may be disposed on at least one of top and bottom surfaces of the main body 451. Thus, the inclined surface may be disposed inclined with respect to a top surface of the switching device 400 or the top surface 220.

As the inclined surface may be disposed on the bottom surface of the main body 451, a contact area between the disk 450 and the switching device 400 may be reduced. Also, as the inclined surface may be disposed on the top surface of the main body 451, a contact area between the disk 450 and the top surface 220 may be reduced. Thus, a phenomenon in which the switching device 400 adheres due to the oil existing on the third wall 230 and the top surface 220 may be prevented.

The through-hole 455 may have a relatively large size when compared to the through-hole 355 of FIG. 15. For example, the through-hole 455 may have a size corresponding to a size of the recess 330 of FIG. 15.

A contact area between the top surface 220 and the disk 450 or a contact area between the disk 450 and the switching device 400 may be reduced by the through-hole 455. Thus, a phenomenon in which the switching device 400 adheres due to the oil existing on the third wall 230 and the top surface 220 may be prevented.

The inclined surface of the disk 450 may be referred to as a "first adhesion preventer", and the through-hole 455 may be referred to as a "second adhesion preventer".

The through-hole may perform a function to uniformly transmit a pressure of an external refrigerant, which is applied from a discharge pressure apply hole 228, to the switching device 400. The main body 451 of the disk 450 may have a horizontal diameter D2 less than a horizontal diameter D1 of the switching device 400. Also, a value of D1-D2 may be greater than a first set or predetermined value and less than a second set or predetermined value. For example, the first set value may be about 0.3 mm, and the second set value may be about 1.0 mm.

If the value of D1-D2 is less than the first set value, operation noise between the switching device 400 and the disk 450 may increase. If the value of D1-D2 is greater than the second set value, stress generated when the switching device 400 collides with the disk 450 may be concentrated on or at a predetermined position on the top surface of the switching device 400, causing abrasion of the switching device 400.

Figure 19:
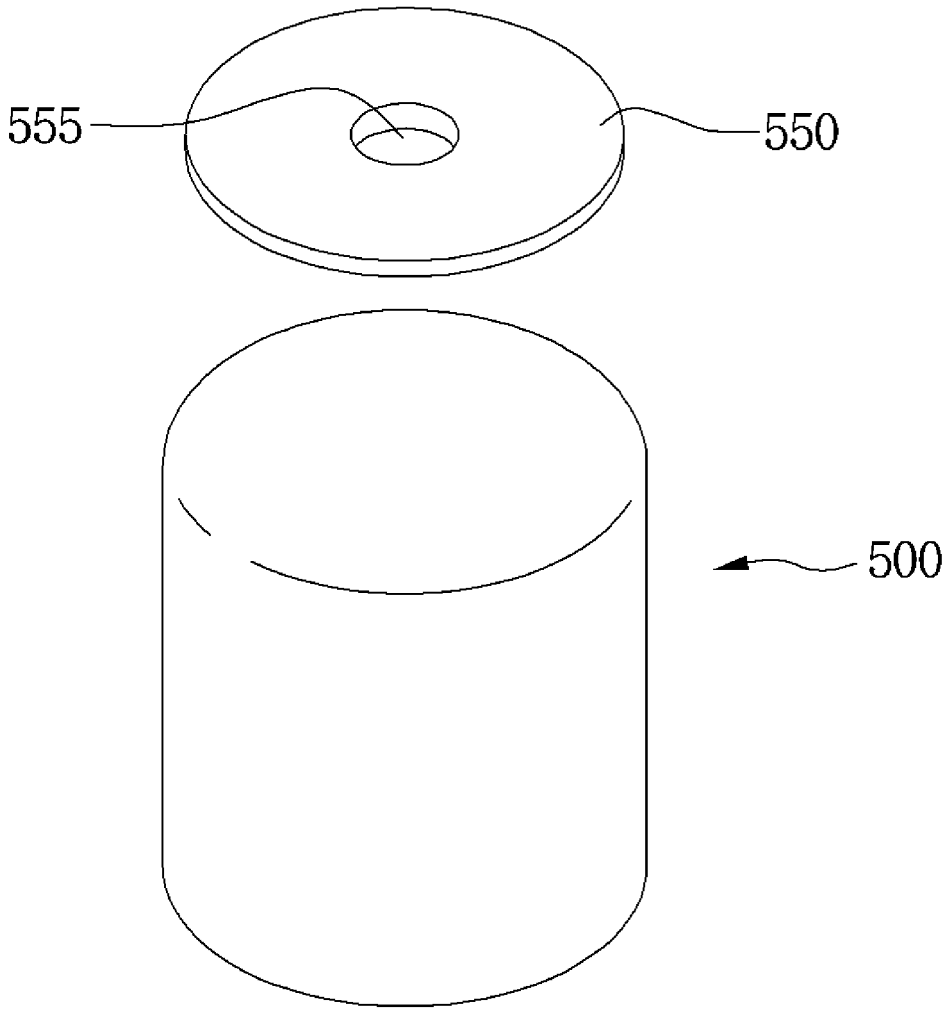
FIG. 19 is a view of a switching device and a disk according to still another embodiment.

FIG. 19 is a view of a switching device and a disk according to still another embodiment. Referring to FIG. 19, scroll compressor 100 according to this embodiment may include a switching device 500 movably disposed inside third wall 230, and a disk 550 disposed between the switching device 500 and top surface 220.

The switching device 500 may have a cylindrical shape. Further, the switching device 400 may selectively open discharge hole 145 and be vertically movable.

The disk 550 may be disposed movable in a space between a top surface of the switching device 500 and the top surface 220. The disk 550 may be provided to prevent the switching device 500 from directly adhering or colliding with the top surface 220.

A through-hole 555 may be defined in or at an approximately central portion of the disk 550. As described with respect to the previous embodiment, the switching device 500 may easily approach the disk 550 due to the through-hole 555, and the disk 550 may perform a buffer function for the switching device 500.

According to embodiments, the movable switching device may be provided for the back pressure portion. Thus, when the scroll compressor operates, the discharge hole may be opened. Also, when the scroll compressor is stopped, the discharge pressure apply hole may be opened. Thus, reliability in flow of the refrigerant may be secured.

Also, as the recess may be defined in the switching device, a contact area between the wall surrounding the switching device and the switching device may be reduced. Thus, restriction in movement of the switching device due to viscosity of oil (working oil) existing around the switching device and the wall may be prevented. Thus, operation reliability of the switching device may be improved.

Also, the protrusion may extend upward from the discharge pressure apply hole to prevent noise due to backward flow of the refrigerant discharged from the intermediate discharge hole toward the discharge pressure apply hole from occurring and prevent the switching device from being pressed downward.

The discharge guide may be disposed on or at a side of the fixed scroll or the orbiting scroll. Thus, when the second compressor is stopped, as the intermediate pressure refrigerant existing in the back pressure chamber may be discharged toward the compression chamber through the discharge guide, an equilibrium pressure within the scroll compressor may be maintained, and thus, the compressor may quickly re-operate.

Also, a portion of the wrap of the orbiting scroll or the fixed scroll may be recessed to form the discharge guide. While the orbiting scroll revolves, the back pressure chamber, the discharge guide, and the compression chamber may be disposed to always communicate with each other, thereby preventing the wrap of the orbiting scroll from sealing the back pressure chamber.

Embodiments disclosed provide a scroll compressor with improved operation reliability to quickly re-operate.

Embodiments disclosed herein provide a scroll compressor that may include a casing including a rotational shaft; a cover fixed inside of the casing to partition the inside of the casing into a suction space and a discharge space; a first scroll revolving by rotation of the rotational shaft; a second scroll disposed on or at one side of the first scroll to define a compression chamber together with the first scroll, the second scroll including a discharge part or hole, through which a refrigerant pressed in the compression chamber may be discharged; a switching device movably disposed on or at one side of the discharge part to selectively open and close the discharge part; a back pressure part or portion including a moving guide part or guide that accommodates at least a portion of the switching device, and a top surface part on top surface that covers one side of the switching device; and an adhesion prevention part or preventer to reduce a contact area between the switching device and at least a portion of the back pressure part. The adhesion prevention part may include a recess part or recess defined in the switching device to reduce the contact area between the switching device and the at least a portion of the back pressure part.

The back pressure part may include a support supported by a second head plate of the second scroll, the support having a hollow annular shape; a first wall that extends from an inner circumferential surface of the support, the first wall having a cylindrical shape; and a second wall that extends from an outer circumferential surface of the support, the second wall having a cylindrical shape.

The moving guide part may be disposed to be spaced apart from an inside of the second wall. An intermediate discharge part or hole, through which a refrigerant discharged from the discharge part of the second scroll may flow, may be disposed in a space between an outer surface of the moving guide part and an inner surface of the second wall.

A discharge pressure apply hole that applies a pressure of the discharge space to the switching device to allow the switching device to move may be defined in the top surface part. The recess part may have a width or diameter greater than that of the discharge pressure apply hole.

The switching device may include a body part or body having an outer circumferential surface having a cylindrical shape, and an opposite surface that is disposed opposite to the discharge pressure apply hole of the top surface part. The recess part may be recessed from the opposite surface. The recess part may be recessed from the outer circumferential surface of the body part. The recess part may be recessed from an outer circumferential surface of the body part and disposed at a position that is spaced apart from the opposite surface.

The switching device may be disposed to contact the top surface part of the back pressure part when the refrigerant is discharged through the discharge part of the second scroll, and when compression of the refrigerant in the compression chamber is stopped, the switching device may be spaced apart from the top surface part of the back pressure part by a refrigerant pressure applied to the discharge pressure apply hole. The scroll compressor may further include a disk that is movably disposed between the switching device and the top surface part.

The adhesion prevention part may have a through-hole defined in the disk. The disk may include a main body having an inclined surface that is inclined with respect to a top surface of the switching device or the top surface part, and at least a portion of the main body may pass through the through-hole. The main body may have a diameter less than that of one surface of the switching device. When the compression of the refrigerant in the compression chamber is stopped, the switching device may be spaced apart from the top surface part of the back pressure part by a refrigerant pressure applied to the discharge pressure apply hole.

The first scroll and the second scroll may define a plurality of compression chambers, and an intermediate pressure discharge hole that communicates with the compression chamber having an intermediate pressure of the plurality of compression chambers may be defined in the second scroll. The back pressure part may include an intermediate pressure suction hole that communicates with the intermediate pressure discharge hole.

The scroll compressor may further include a floating plate movably disposed on or at one side of the back pressure part to define a back pressure chamber together with the back pressure part. The first scroll may include a first head plate coupled to the rotational shaft, and a first wrap that extends from the first head plate in one direction, and a guide recess part or guide to guide discharge of the refrigerant within the back pressure chamber may be defined in the first wrap.

The details of one or more embodiments are set forth in the accompanying drawings and the description. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing comprising a rotational shaft;

a cover fixed inside of the casing to partition an inner space of the casing into a suction space and a discharge space;

a first scroll that is revolved by rotation of the rotational shaft;

a second scroll disposed on or at one side of the first scroll to define a compression chamber together with the first scroll, wherein the second scroll comprises a discharge hole through which a refrigerant compressed in the compression chamber is discharged;

a switching device movably disposed on or at one side of the discharge hole to selectively open and close the discharge hole;

a back pressure portion comprising a moving guide that accommodates at least a portion of the switching device and a top surface that covers one side of the switching device, the top surface having a discharge pressure apply hole that applies a pressure of the discharge space to the switching device to allow the switching device to move, wherein the switching device comprises:

a body having an outer circumferential surface;

an opposite surface disposed opposite to the discharge pressure apply hole of the top surface; and a recess recessed from at least one of the opposite surface or the outer circumferential surface of the body, to reduce a contact area between the switching device and at least a portion of the back pressure portion.

2. The scroll compressor according to claim 1, wherein the back pressure portion comprises:

a support supported by a head plate of the second scroll, the support having a hollow annular shape;

a first wall that extends from an inner circumferential surface of the support, the first wall having a cylindrical shape; and a second wall that extends from an outer circumferential surface of the support, the second wall having a cylindrical shape.

3. The scroll compressor according to claim 2, wherein the moving guide is spaced apart from an inner circumferential surface of the second wall, and wherein at least one intermediate discharge hole, through which a refrigerant discharged from the discharge hole of the second scroll flows, is disposed in a space between an outer circumferential surface of the moving guide and the inner circumferential surface of the second wall.

4. The scroll compressor according to claim 1, wherein the recess has a width or diameter greater than a width or diameter of the discharge pressure apply hole.

5. The scroll compressor according to claim 1, wherein the recess comprises at least one recess that extends from the opposite surface along a length of the body.

6. The scroll compressor according to claim 5, wherein the at least one recess comprises a plurality of recesses that extends from the opposite surface along a length of the body and spaced a predetermined distance apart in a circumferential direction.

7. The scroll compressor according to claim 1, wherein the recess comprises at least one recess recessed from an outer circumferential surface of the body.

8. The scroll compressor according to claim 1, wherein the at least one recess comprises a plurality of recesses recessed from an outer circumferential surface of the body and spaced a predetermined distance apart in a circumferential direction.

9. The scroll compressor according to claim 8, wherein the plurality of recesses are spaced along a lengthwise direction of the body as well as along the circumferential direction of the body.

10. The scroll compressor according to claim 1, wherein the switching device is disposed to contact the top surface of the back pressure portion when the refrigerant is discharged through the discharge hole of the second scroll, and wherein when compression of the refrigerant in the compression chamber is stopped, the switching device is spaced apart from the top surface of the back pressure portion by a refrigerant pressure applied to the discharge pressure apply hole.

11. The scroll compressor according to claim 3, further comprising a flow restricter disposed on the top surface to restrict introduction of the refrigerant flowing through the intermediate discharge hole into the discharge pressure apply hole.

12. The scroll compressor according to claim 11, wherein the flow restricter comprises a protrusion that protrudes from the top surface to surround the discharge pressure apply hole.

13. The scroll compressor according to claim 12, wherein an upper end of the first wall is disposed at a position higher than a position of the top surface.

14. The scroll compressor according to claim 12, further comprising a floating plate disposed in a space defined by the first wall, the second wall, and the support to form a back pressure chamber, wherein the floating plate comprises a rib that protrudes toward the cover, and wherein the rib contacts the cover when the refrigerant is compressed, and when compression of the refrigerant is stopped, the rib moves away from the cover.

15. The scroll compressor according to claim 1, further comprising a disk movably disposed between the switching device and the top surface, the disk having a through-hole.

16. The scroll compressor according to claim 15, wherein the disk comprises a main body having an inclined surface inclined with respect to a top surface of the switching device or the top surface, and wherein the through-hole is formed to pass through at least a portion of the main body.

17. The scroll compressor according to claim 1, wherein the first scroll comprises an orbiting scroll and the second scroll comprises a fixed scroll.

18. A scroll compressor, comprising:

a casing comprising a rotational shaft;

a cover fixed inside the casing to partition an inner space of the casing into a suction space and a discharge space;

a first scroll that is revolved by rotation of the rotational shaft;

a second scroll disposed on or at one side of the first scroll to define a compression chamber together with the first scroll, wherein the second scroll comprises a discharge hole through which a refrigerant compressed in the compression chamber is discharged; and a back pressure portion coupled to the second scroll, wherein the back pressure portion comprises:

a support supported by the second scroll, the support having an annular shape;

a first wall that extends from an inner circumferential surface of the support;

a second wall spaced inward from the first wall;

a top surface disposed on an upper portion of the second wall, the top surface having a discharge pressure apply hole to which a pressure of a refrigerant in the discharge space is applied;

at least one intermediate discharge hole disposed between the first wall and the second wall to allow the refrigerant discharged from the discharge hole to flow therethrough; and a protrusion that protrudes from the top surface to surround the discharge pressure apply hole.

19. The scroll compressor according to claim 18, wherein the at least one intermediate discharge hole comprises a plurality of intermediate discharge holes, and wherein the discharge pressure apply hole is defined at a central portion of the top surface, and the plurality of intermediate discharge holes is defined outside of the discharge pressure apply hole.

20. The scroll compressor according to claim 18, further comprising a switching device movably disposed inside the second wall to selectively open and close the discharge hole of the second scroll.

21. The scroll compressor according to claim 20, wherein the switching device moves toward the discharge pressure apply hole to open the discharge hole of the second scroll when the refrigerant is discharged through the discharge hole, and wherein when compression of the refrigerant in the compression chamber is stopped, the switching device is spaced apart from the discharge pressure apply hole to close the discharge hole of the second scroll.

22. The scroll compressor according to claim 20, further comprising a disk movably disposed between the switching device and the top surface and having a through-hole.

23. The scroll compressor according to claim 18, wherein the first scroll and the second scroll define a plurality of compression chambers, and wherein at least one intermediate pressure discharge hole that communicates with the compression chamber having an intermediate pressure of the plurality of compression chambers is defined in the second scroll.

24. The scroll compressor according to claim 23, wherein the back pressure portion comprises at least one intermediate pressure suction hole that communicates with the at least one intermediate pressure discharge hole.

25. The scroll compressor according to claim 18, further comprising a floating plate movably disposed at one side of the back pressure portion to define a back pressure chamber together with the back pressure portion.

26. The scroll compressor according to claim 25, wherein the first scroll comprises a head plate coupled to the rotational shaft and a wrap that extends from the head plate in one direction, and wherein a guide recess that guides discharge of the refrigerant within the back pressure chamber is defined in the wrap.

27. The scroll compressor according to claim 18, wherein the first scroll comprises an orbiting scroll and the second scroll comprises a fixed scroll.

28. A scroll compressor, comprising:

a casing comprising a rotational shaft;

a cover fixed inside of the casing to partition an inner space of the casing into a suction space and a discharge space;

a first scroll that is revolved by rotation of the rotational shaft;

a second scroll disposed on or at one side of the first scroll to define a compression chamber together with the first scroll, wherein the second scroll comprises a discharge hole through which a refrigerant compressed in the compression chamber is discharged;

a switching device movably disposed on or at one side of the discharge hole to selectively open and close the discharge hole;

a back pressure portion comprising a moving guide that accommodates at least a portion of the switching device and a top surface that covers one side of the switching device;

a disk movably disposed between the switching device and the top surface; and a through-hole defined in the disk, to reduce a contact area between the switching device and at least a portion of the back pressure portion.

* * * * *